US007412390B2

(12) United States Patent
Kobayashi et al.

(10) Patent No.: US 7,412,390 B2
(45) Date of Patent: Aug. 12, 2008

(54) METHOD AND APPARATUS FOR SPEECH SYNTHESIS, PROGRAM, RECORDING MEDIUM, METHOD AND APPARATUS FOR GENERATING CONSTRAINT INFORMATION AND ROBOT APPARATUS

(75) Inventors: Erika Kobayashi, Tokyo (JP); Toshiyuki Kumakura, Tokyo (JP); Makoto Akabane, Tokyo (JP); Kenichiro Kobayashi, Kanagawa (JP); Nobuhide Yamazaki, Kanagwa (JP); Tomoaki Nitta, Tokyo (JP); Pierre Yves Oudeyer, Paris (FR)

(73) Assignees: Sony France S.A., Clichy (FR); Sony Corporation, Tokyo (JP)

( * ) Notice: Subject to any disclaimer, the term of this patent is extended or adjusted under 35 U.S.C. 154(b) by 954 days.

(21) Appl. No.: 10/387,659

(22) Filed: Mar. 13, 2003

(65) Prior Publication Data

US 2004/0019484 A1 Jan. 29, 2004

(30) Foreign Application Priority Data

Mar. 15, 2002 (EP) ..... 02290658

(51) Int. Cl.
*G10L 13/00* (2006.01)
*G10L 13/06* (2006.01)

(52) U.S. Cl. ..... 704/267; 704/258

(58) Field of Classification Search ..... 704/258, 704/267

See application file for complete search history.

(56) References Cited

U.S. PATENT DOCUMENTS 4,817,161 A * 3/1989 Kaneko ..... 704/267
5,029,214 A * 7/1991 Hollander ..... 704/272
5,796,916 A * 8/1998 Meredith ..... 704/258
5,860,064 A * 1/1999 Henton ..... 704/260
6,598,020 B1 * 7/2003 Kleindienst et al. ..... 704/270
6,810,378 B2 * 10/2004 Kochanski et al. ..... 704/258

(Continued)

OTHER PUBLICATIONS

Taylor, Paul A. "A Phonetic Model of English Intonation," A thesis submitted for the degree of Doctor of Pholosophy, University of Edinburgh, 1992.*

(Continued)

*Primary Examiner*—David R. Hudspeth
*Assistant Examiner*—Eunice Ng
(74) *Attorney, Agent, or Firm*—Frommer Lawrence & Haug LLP; William S. Frommer; Paul A. Levy

(57) ABSTRACT

The emotion is to be added to the synthesized speech as the prosodic feature of the language is maintained. In a speech synthesis device 200, a language processor 201 generates a string of pronunciation marks from the text, and a prosodic data generating unit 202 creates prosodic data, expressing the time duration, pitch, sound volume or the like parameters of phonemes, based on the string of pronunciation marks. A constraint information generating unit 203 is fed with the prosodic data and with the string of pronunciation marks to generate the constraint information which limits the changes in the parameters to add the so generated constraint information to the prosodic data. A emotion filter 204, fed with the prosodic data, to which has been added the constraint information, changes the parameters of the prosodic data, within the constraint, responsive to the feeling state information, imparted to it. A waveform generating unit 205 synthesizes the speech waveform based on the prosodic data the parameters of which have been changed.

59 Claims, 14 Drawing Sheets

U.S. PATENT DOCUMENTS

| | | | | |
|---|---|---|---|---|
| 6,826,530 | B1 * | 11/2004 | Kasai et al. | 704/258 |
| 6,901,390 | B2 * | 5/2005 | Mizokawa | 706/14 |
| 2001/0021907 | A1 * | 9/2001 | Shimakawa et al. | 704/260 |
| 2002/0198717 | A1 * | 12/2002 | Oudeyer et al. | 704/270 |
| 2003/0028380 | A1 * | 2/2003 | Freeland et al. | 704/260 |
| 2004/0024602 | A1 * | 2/2004 | Kariya | 704/270 |

OTHER PUBLICATIONS

O. Mizuno and S. Nakajima. "New Prosodic Control Rules for Expressive Synthetic Speech," ICSLP-1998.*

E. Nöth, A. Batliner, A. Kieβling, R. Kompe, and H. Niemann, "VERBMOBIL: The Use of Prosody in the Linguistic Components of a Speech Understanding System," IEEE Transactions on Speech and Audio Processing, 2000.*

W. Zhu, W. Zhang, Q. Shi, and F. Chen, "Corpus Building for Data-Driven TTS Systems,"Proceedings of IEEE Workshop on Speech Synthesis, 2002.*

Klatt, Dennis H., "Review of text-to-speech conversion for English," Journal of the Acoustical Society of America, 1987.*

* cited by examiner

| | INPUT EVENT NAME | DATA NAME | DATA RANGE | PROBABILITY OF TRANSITION TO OTHER NODE | | | | | |
|---|---|---|---|---|---|---|---|---|---|
| node 100 | | | | A | B | C | D | | n |
| TRANSITION DESTINATION NODE | | | | node 120 | node 120 | node 1000 | | | node 600 |
| OUTPUT BEHAVIOR | | | | ACTION 1 | ACTION 2 | MOVE BACK | | | ACTION 4 |
| 1 | BALL | SIZE | 0.1000 | 30% | | | | | |
| 2 | PAT | | | | 40% | | | | |
| 3 | HIT | | | | 20% | | | | |
| 4 | MOTION | | | | | 50% | | | |
| 5 | OBSTACLE | DISTANCE | 0.100 | | | 100% | | | |
| 6 | | JOY | 50.100 | | | | | | |
| 7 | | SURPRISE | 50.100 | | | | | | |
| 8 | | SADNESS | 50.100 | | | | | | |
| | | | | | | | | | |

90

FIG. 13

| | | | | | |
|---|---|---|---|---|---|
| | node XXX | | | | |
| | Condition-label: | | | | |
| | HAPPY | happy>70 | | | |
| | SAD | sad >70 | | | |
| | ANGER | anger>70 | | | |
| | TIMEOUT | timeout.1 | | | |
| MOVEMENT DEFINITIONS ETC. | Arc-label: | | | | |
| | BANZAI | node YYY | talk_happy, motion_banzai | | |
| | OTIKOMU | node ZZZ | talk_sad, motion_ijiiji | | |
| | BURUBURU | node WWW | talk_anger, motion_buruburu | | |
| | AKUBI | node VVV | motion_akubi | | |
| PROBABILITY TABLE | Probabiliy-table: | | | | |
| | | BANZAI | OTIKOMU | BURUBURU | AKUBI |
| | HAPPY | 100 | | | |
| | SAD | | 100 | | |
| | ANGER | | | 100 | |
| | TIMEOUT | | | | 100 |

FIG. 14

METHOD AND APPARATUS FOR SPEECH SYNTHESIS, PROGRAM, RECORDING MEDIUM, METHOD AND APPARATUS FOR GENERATING CONSTRAINT INFORMATION AND ROBOT APPARATUS

BACKGROUND OF THE INVENTION

1. Field of the Invention

This invention relates to a method and apparatus for speech synthesis, program, recording medium for receiving information on the emotion to synthesize the speech, method and apparatus for generating constraint information, and robot apparatus outputting the speech.

2. Description of Related Art

A mechanical apparatus for performing movements simulating the movement of the human being using electrical or magnetic operation is termed a "robot". The robots started to be used widely in this country towards the end of the sixtieth. Most of the robots used were industrial robots, such as manipulators or transporting robots, aimed at automation or unmanned operations in plants.

Recently, developments in practically useful robots, supporting the human life as a partner for the human being, that is supporting human activities in variable aspects of our everyday life, are proceeding. In distinction from the industrial robots, these useful robots have the ability of learning the method for adaptation to the human being with different personality or to variable environments under variable aspects of the human living environment. For example, a pet type robot, simulating the bodily mechanism of animals walking on four feet, such as dogs or cats, or a 'humanoid' robot, designed after the bodily mechanism or movements of the human being walking on two feet, are already put to practical use.

These robots can perform various operations, aimed principally at entertainments, as compared to industrial robots, and hence are sometimes termed entertainment robots. Some of these robot apparatus autonomously operate responsive to the information from outside or to their internal states.

The artificial intelligence (AI), used in these autonomously operating robots, represents artificial realization of intellectual functions, such as inference or judgment. Attempts are also being made to artificially realize the functions, such as emotion or instincts. As an illustration of the acoustic means, among the means of expression of the artificial intelligence to outside, including the visual means, is the use of speech.

For example, in the robot apparatus simulating the human being, such as dogs or cats, the function of appealing the own emotion to the human user using the speech, is effective. The reason is that, even if the user is unable to understand what is said by actual dogs or cats, he or she is able to empirically understand the condition of the dog or cat, and that one of the elements in judgment is the pet's speech. In the case of the human being, the emotion of the person who uttered the speech is judged on the basis of the meaning or contents of the word or the speech uttered.

Among the robot apparatus, now on market, there is known such a one which expresses the auditory emotion by the electronic sound. Specifically, short sound with a high pitch represents happiness, while the slow low sound represents sadness. These electronic sounds are pre-composed and assorted to different emotion classes so as to be used for reproduction based on the subjective turn of mind of the human being. The emotion class is the class of emotion classified under happiness, anger etc. In the customary auditory emotion representation, employing the electronic sound, such points as (i) monotony;

(ii) repetition of the same expression and (iii) indefiniteness as to whether or not the power of expression is proper are pointed out as being the principal difference from the emotion expression by the pets, such as dogs or cats, such that further improvement has been desired.

In the specification and drawings of the JP Patent Application 2000-372091, the present Assignee proposed a technique which enables an autonomous robot apparatus to make the auditory emotion expression more proximate to that of the living creatures. In this technique, there is first prepared a table showing certain parameters, such as pitch, time duration and sound volume (intensity) of at least part of phonemes contained in the sentence or the sound array to be synthesized, in association with the emotion, such as happiness or anger. This table is switched, depending on the emotion of the robot, as verified, to execute speech synthesis to produce utterances representing the emotion. By the robot uttering the so generated nonsensical utterances, tuned to emotion representation, the human being is able to be informed of the emotion entertained by the robot, even though the contents of the utterances uttered by the robot are not quite clear.

However, the technique disclosed in the specification and drawings of the JP Patent Application 2000-372091 is premised on the robot making nonsensical utterances. Therefore, various problems are presented if the above technique is applied to a robot apparatus simulating the human being and which has the function of outputting the meaningful synthesized speech of a specific language.

That is, if the emotion is added to the nonsensical utterances, there is no particular constraint, imposed from a specified language to another, as to which portion of the output sound a change is to be made. Thus, the portion of the output sound can be identified on the basis of the probability or the position in the sentence. However, if the same technique is applied to the emotion-synthesis of the meaningful sentence, it is not clear which portion of the sentence to be synthesized is to be modified or how the portion not allowed to be changed is to be determined. As a result, the prosody, inherently essential in imparting the language information, is changed, so that the meaning can hardly be transmitted, or the meaning different from the original meaning is imparted to the listener.

The case of using an approach of changing the pitch is taken as an example for explanation. The Japanese is a language which expresses the accent based on the pitch of speech. In Japanese words, the accent position is determined, such that the accent position as expected by a Japanese native speaker from a given sentence is determined approximately. Therefore, if the pitch of a phoneme is changed using the approach of expressing the emotion by changing the pitch, the risk is high that the resulting synthesized speech imparts an extraneous feeling to the Japanese native speaker.

There is also a possibility that not only an extraneous emotion is transmitted but also the meaning is not transmitted. In the case of a word 'hashi', meaning 'chopstick,' 'bridge' or 'end', the hearer discriminates the 'chopstick,' 'bridge' or 'end' based on whether the sound of 'ha' is higher or lower than the sound 'shi'. Therefore, if, when the emotion is to be expressed based on the relative pitch, the relative pitch of the speech portion essential in the meaning discrimination is changed in the language of the speech being synthesized, the hearer is unable to understand the meaning correctly.

The same holds for the case of using an approach towards changing the time duration. For example, if, in synthesizing the word 'Oka-san' meaning Mr.Oka, the duration of the phoneme 'a' of a sound 'ka' is changed to be longer than the duration of the other phonemes, the hearer may take the output synthesized speech as 'Okaasan' (meaning my mother).

The Japanese is not a language discriminating the meaning based on the relative intensity of the sound and hence changes in the sound intensity scarcely lead to the ambiguous meaning. In a language in which the relative intensity of the sound leads to different meanings, as in English, the relative sound intensity is used to differentiate words of the same spell but of different meanings, and hence there may arise the situation that the meaning is not transmitted correctly. For example, in the case of a word 'present', the stress in the first syllable gives a noun meaning a 'gift', whereas the stress in the second syllable gives a verb meaning 'offer' or 'present oneself'.

If the speech is to be synthesized for a meaningful sentence, seasoned with emotion, there is a risk that, except if control is made so that the prosodic characteristics of the language in question, such as accent positions, duration or loudness, are maintained, the hearer is unable to understand the meaning of the synthesized speech correctly.

SUMMARY OF THE INVENTION

It is therefore an object of the present invention to provide a method and apparatus for speech synthesis, program, recording medium, method and apparatus for generating constraint information, and a robot apparatus, in which the emotion can be added to the synthesized speech as the prosodic characteristics of the language in question are maintained.

In one aspect, the present invention provides a speech synthesis method for receiving information on the emotion to synthesize the speech, including a prosodic data forming step of forming prosodic data from a string of pronunciation marks which is based on an uttered text, uttered as speech, a constraint information generating step of generating the constraint information used for maintaining prosodical features of the uttered text, a parameter changing step of changing parameters of the prosodic data, in consideration of the constraint information, responsive to the information on the emotion, and a speech synthesis step of synthesizing the speech based on the prosodic data the parameters of which have been changed in the parameter changing step.

In this speech synthesis method, the uttered speech is synthesized based on the parameters of the prosodic data modified depending on the information on the emotion. Moreover, since the constraint information for maintaining the prosodic feature of the uttered text is taken into consideration in changing the parameters, the uttered speech contents, for example, are not changed as a result of the parameter changes.

In another aspect, the present invention provides a speech synthesis method for receiving information on the emotion to synthesize the speech, including a data inputting step for inputting prosodic data which is based on the test uttered as speech and the constraint information for maintaining the prosodic feature of the uttered text, a parameter changing step of changing parameters of the prosodic data, in consideration of the constraint information, responsive to the information on the emotion and a speech synthesis step of synthesizing the speech based on the prosodic data the parameters of which have been changed in the parameter changing step.

Thus, the uttered speech may be synthesized based on the parameters of the prosodic data changed depending on the information on the emotion. Since the constraint information for maintaining the prosodic feature of the uttered text is taken into consideration in this manner in changing the parameters, the uttered speech contents, for example, are not changed as a result of the parameter changes.

With this speech synthesis method, the prosodic data which is based on the uttered text, and the constraint information for maintaining the prosodic features of the uttered text, are input, and the uttered speech is synthesized, responsive to the emotion state of the emotion model of the constraint information, based on the parameters of the prosodic data changed in light of the constraint information. Since the constraint information is taken into consideration in changing the parameters, there is no risk of the uttered contents etc being changed with the changes in the parameters.

In still another aspect, the present invention provides a speech synthesis apparatus for receiving information on the emotion to synthesize the speech, including prosodic data generating means for generating prosodic data from a string of pronunciation marks which is based on a text uttered as speech, constraint information generating means for generating the constraint information adapted for maintaining the prosodic feature of the uttered text, parameter changing means for changing parameters of the prosodic data, in consideration of the constraint information, responsive to the information on the emotion, and speech synthesis means for synthesizing the speech based on the prosodic data the parameters of which have been changed by the parameter changing means.

Thus, the uttered speech can be synthesized based on the parameters of the prosodic data changed responsive to the information on the emotion. Moreover, since the constraint information for maintaining the prosodic feature of the uttered text is taken into consideration in changing the parameters, the uttered contents, for example, are not changed as a result of the change in the parameters.

In still another aspect, the present invention provides a speech synthesis apparatus for receiving information on the emotion to synthesize the speech, including data inputting means for inputting prosodic data which is based on the uttered text uttered as speech, and the constraint information for maintaining the prosodical feature of the uttered text, parameter changing means for changing the parameters of the prosodic data, in consideration of the constraint information, responsive to the emotion state of the emotion model in the parameter changing step, and speech synthesis means for synthesizing the speech based on the prosodic data the parameters of which have been changed in the parameter changing step.

In this speech synthesis device, the prosodic data which is based on the uttered text, and the control information for maintaining the prosodic feature of the uttered text, are input, and the uttered speech is synthesized, responsive to the information on the emotion, based on the parameters of the prosodic data changed in light of the constraint information. Since the constraint information is taken into consideration in changing the parameters, the uttered contents are not changed with changes in the parameters.

The program according to the present invention causes the computer to execute the above-described speech synthesis processing, while the recording medium according to the present invention has this program recorded thereon and can be read by the computer.

With the program or the recording medium, the uttered speech can be synthesized based on the parameters of the prosodic data changed depending on the emotion state of the emotion model of the speech uttering entity. Moreover, in changing the parameters, the uttered contents etc are not changed by such changes in the parameters, because the constraint information for maintaining the prosodic feature of the uttered text is taken into consideration.

In still another aspect, the present invention provides a method for generating the constraint information including a constraint information generating step of being fed with a string of pronunciation marks specifying an uttered text, uttered as speech, for generating the constraint information for maintaining the prosodic feature of the uttered text when changing parameters of prosodic data prepared from the string of pronunciation marks in accordance with the parameter change control information. Thus, with the present control generating method, the uttered contents are not changed with changes in the parameters.

That is, since the constraint information for maintaining the prosodic feature of the uttered text is generated when the parameters of the prosodic data are changed in accordance with the parameter change control information, there is no risk of changes in the uttered contents brought about by the changes in the parameters.

In still another aspect, the present invention provides an apparatus for generating the constraint information including constraint information generating means for being fed with a string of pronunciation marks specifying an uttered text, uttered as speech, for generating the constraint information for maintaining the prosodic feature of the uttered text when changing parameters of prosodic data prepared from the string of pronunciation marks in accordance with the parameter change control information, whereby the uttered speech contents are not changed with changes in the parameters.

With the above-described constraint information generating apparatus, in which the constraint information for maintaining the prosodic feature of the uttered text is generated when changing the parameters of the prosodic data in accordance with the parameter change control information, the uttered speech contents are not changed as a result of the changes in the parameters.

In yet another aspect, the present invention provides a autonomous robot apparatus performing a movement based on the input information supplied thereto, including a emotion model ascribable to the movement, emotion discrimination means for discriminating the emotion state of the emotion model, prosodic data creating means for creating prosodic data from a string of pronunciation marks which is based on the text uttered as speech, constraint information generating means for generating the constraint information adapted for maintaining the prosodic feature of the uttered text, parameter changing means for changing the parameters of the prosodic data, in consideration of the constraint information, responsive to the emotion state discriminated by the discriminating means, and speech synthesizing means for synthesizing the speech based on the prosodic data the parameters of which have been changed by the parameter changing means.

The above-described robot apparatus synthesizes the speech based on the parameters of the prosodic data changed in keeping with the emotion state of the emotion model. Since the constraint information for maintaining the prosodic feature of the uttered text is taken into consideration in changing the parameters, the uttered contents are not changed due to changes in the parameters.

In yet another aspect, the present invention provides a autonomous robot apparatus performing a movement based on the input information supplied thereto, including a emotion model ascribable to the movement, emotion discrimination means for discriminating the emotion state of the emotion model, data inputting means for inputting prosodic data which is based on the test uttered as speech and the constraint information for maintaining the prosodic feature of the uttered text, parameter changing means for changing the parameters of the prosodic data, in consideration of the constraint information, responsive to the emotion state discriminated by the discriminating means, and speech synthesizing means for synthesizing the speech based on the prosodic data the parameters of which have been changed by the parameter changing means.

In the above-described robot apparatus, the prosodic data which is based on the uttered text, and the control information for maintaining the prosodic feature of the uttered text, are input, and the uttered speech is synthesized, responsive to the emotion state discriminated by the discriminating means, based on the parameters of the prosodic data changed in light of the constraint information. Since the constraint information is taken into consideration in changing the parameters, the uttered contents are not changed with changes in the parameters.

Before proceeding to describe present embodiments of the speech synthesis methods and apparatus and the robot apparatus according to the present invention, the emotion expression by proper speech is explained.

(1) Emotion Expression by Speech

The addition of the emotion expression to the uttered speech, as a function in e.g., a robot apparatus, simulating the human being, and which has the functions of outputting the meaningful synthesized speech, operates extremely effectively in promoting the intimacy between the robot apparatus and the human being. This is beneficial in many phases other than the phase of promoting the sociability. That is, if the emotions such as satisfaction or dissatisfaction are added to the synthesized speech with otherwise the same meaning and contents, the own emotion can be manifested more definitely, so that the robot apparatus is in a position of requesting stimuli from the human being. This function operates effectively for a robot apparatus having the learning function.

As to the problem of whether or not the emotion of the human being is correlated with acoustic characteristics of the speech, there have been made reports by many researchers. Examples of these include a report by Fairbanks (Fairbanks G., "Recent experimental investigations of vocal pitch in speech", Journal of the Acoustical Society of America (11), 457 to 466, 1940), and a report by Burkhardt (Burkhardt F. and Sendlmeier W. F., "Verification of Acoustic Correlates of Emotional Speech using Formant Synthesis", ISGA Workshop on Speech and Emotion, Belfast 2000).

These reports indicate that speech utterance is correlated with psychological conditions and several emotional classes. There is also a report that it is difficult to find a difference as to specified emotions, such as surprise, fear, boredom or sadness. There is such emotion which is linked with a certain physical state such that a readily predictable effect is brought about on the speech uttered.

For example, if a person feels anger, fear or happiness, he or she has the sympathetic nerve aroused, such that his or her number of heat beats or blood pressure is increased, while he or she feels dry in mouth and has the muscle trembling. At such time, the utterance is loud and quick, while the strong energy is exhibited in the high frequency components. If a person feels bored or said, he or she has the parasympathetic nerve aroused. The number of heat beats or blood pressure of such person is decreased and saliva are secreted. The result is slow and of low pitch. Since these physical features are common to many nations, the correlations not biased by race or culture are thought to exist between the basic emotion and the acoustic characteristics of the speech uttered.

Thus, in the embodiments of the present invention, the correlation between the emotion and the acoustic characteristics are modeled and speech utterance is made on the basis of these acoustic characteristics to express the emotion in the speech. Moreover, in the present embodiments, the emotion is expressed by changing such parameters as time duration, pitch or sound volume (sound intensity) depending on the emotion. At this time, the constraint information, which will be explained subsequently, is added to the parameters changed, so that the prosodic characteristics of the language of the text to be synthesized will be maintained, that is so that no changes will be made in the uttered speech contents.

BRIEF DESCRIPTION OF THE DRAWINGS

The above, and the other objects, features and advantages of the present invention will be made apparent from the following description of the preferred embodiments, given as examples, with reference to the accompanying drawings, in which:

FIG. 13 shows a state transition diagram provided for each node of the finite probability automaton; and FIG. 14 shows a state transition diagram for a speech uttering behavioral model.

DESCRIPTION OF THE PREFERRED EMBODIMENTS

Figure 1:
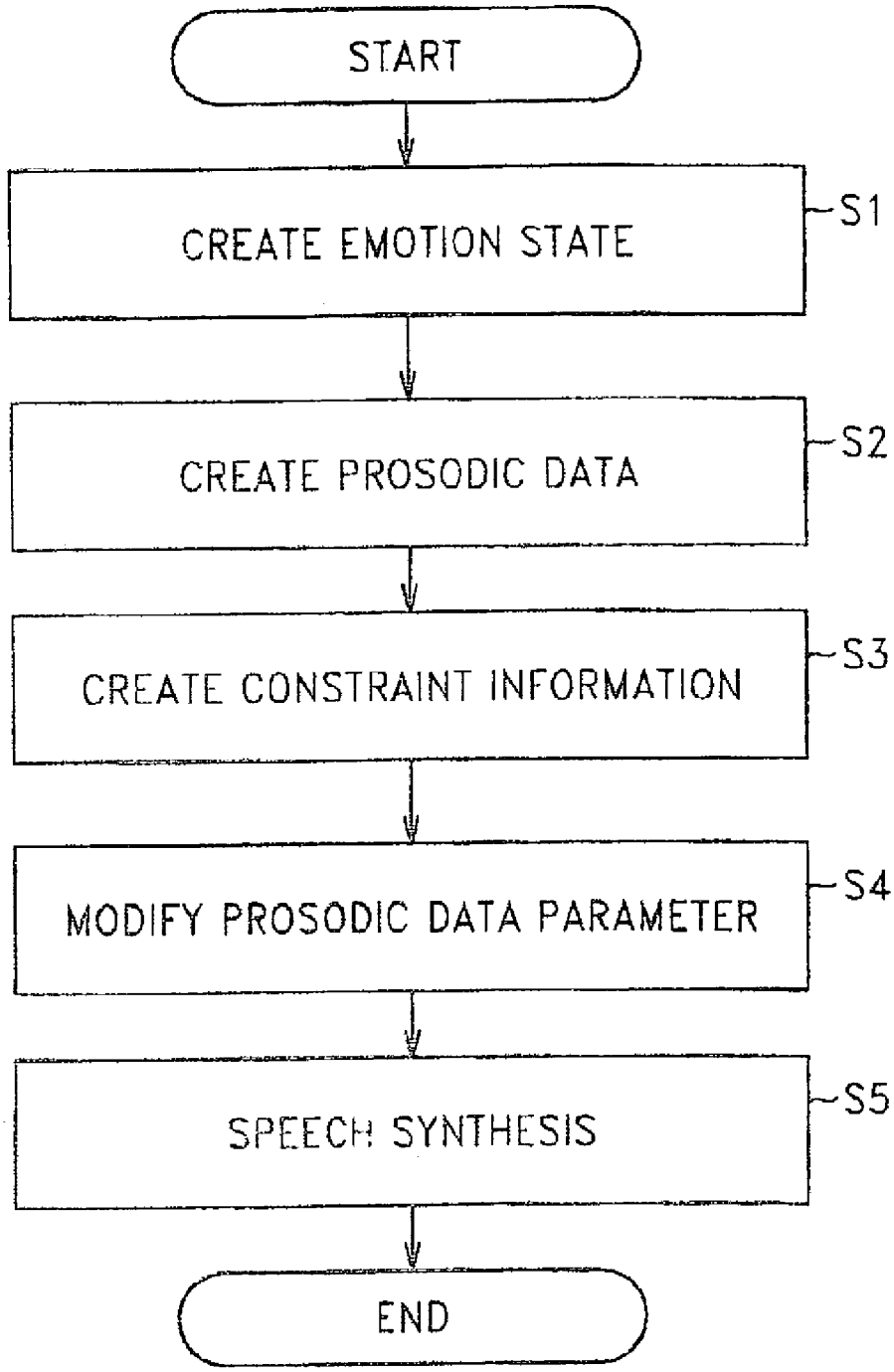
FIG. 1 shows the basic structure of a speech synthesis method in a present embodiment of the present invention.

Referring to the drawings, preferred embodiments of the present invention will be explained in detail.

FIG. 1 shows a flowchart illustrating the basic structure of the speech synthesis method in the present embodiment. Although the method is assumed to be applied to e.g., a robot apparatus at least having the emotion model, speech synthesis means and speech uttering means, this is merely exemplary such that application to various robots or various computer AI (artificial intelligence) is also possible. The emotion model will be explained subsequently. Although the following explanation is directed to the synthesis into Japanese words or sentences, this again is merely exemplary such that application to various other languages is also possible.

At a first step S1 in FIG. 1, the emotion condition of the emotion model of the speaking entity is discriminated. Specifically, the state of the emotion model (emotion condition) is changed depending on the surrounding environments (extraneous factors) or internal states (internal factors). As to the emotion states, it is discriminated which of the calm, anger, sadness, happiness and comfort is the prevailing emotion.

A robot apparatus has, as a behavioral model, an internal probability state transition model, for example, a model having a state transition diagram, as later explained. Each state has a transition probability table which differs with results of recognition, emotion or the instinct value, such that transition to the next state occurs in accordance with the probability and outputs the behavior correlated with this transition.

The behavior of expressing the happiness or sadness by the emotion is stated in this probability state transition model or probability transition table. Typical of this expression behavior is the emotion representation by the speech (by speech utterance). So, in this specified instance, the emotion expression is one of the elements of the behavior determined by the behavioral model referencing the parameter representing the emotion state of the emotion model, and the emotion states are discriminated as part of the functions of the behavior decision unit.

Meanwhile, this specified example is given merely for illustration, such that, at step S1, it is only sufficient to discriminate the emotion state of the emotion model. At the subsequent steps, speech synthesis is carried out which represents the discriminated emotion state by speech.

At the next step S2, prosodic data, representing the duration, pitch and loudness of the phoneme in question, is prepared, by statistical techniques, such as quantification class 1, using the information such as accent types extracted from the string of pronunciation symbols, number of accent phrases in the sentence, positions of the accents in the sentence, number of phonemes in the accent phrases or the types of the phonemes.

At the next step S3, the constraint information is generated which imposes limitations to the change in the parameters of the prosodic data, based on the information such as accent position in the string of pronunciation marks or word boundaries, lest the contents become incomprehensible due to changes in accents.

At the next step S4, parameters of the prosodic data are changed depending on the results of verification of the emotion states at the above step S1. The parameters of the prosodic data means the duration, pitch or the sound volume of the phonemes. These parameters are changed, depending on the discriminated results of the emotion state, such as calm, anger, sadness, happiness or comfort, to make emotion expressions.

Finally, at step S5, the speech is synthesized, in accordance with the parameters changed at step S4. The so produced speech waveform data is sent to a loudspeaker via a D/A converter or an amplifier so as to be uttered as actual speech. For example, in the case of a robot apparatus, this processing is carried out by a so-called virtual robot so that a loudspeaker makes utterances such as to express the prevailing emotion.

(1-2) Structure of the Speech Synthesis Device

Figure 2:
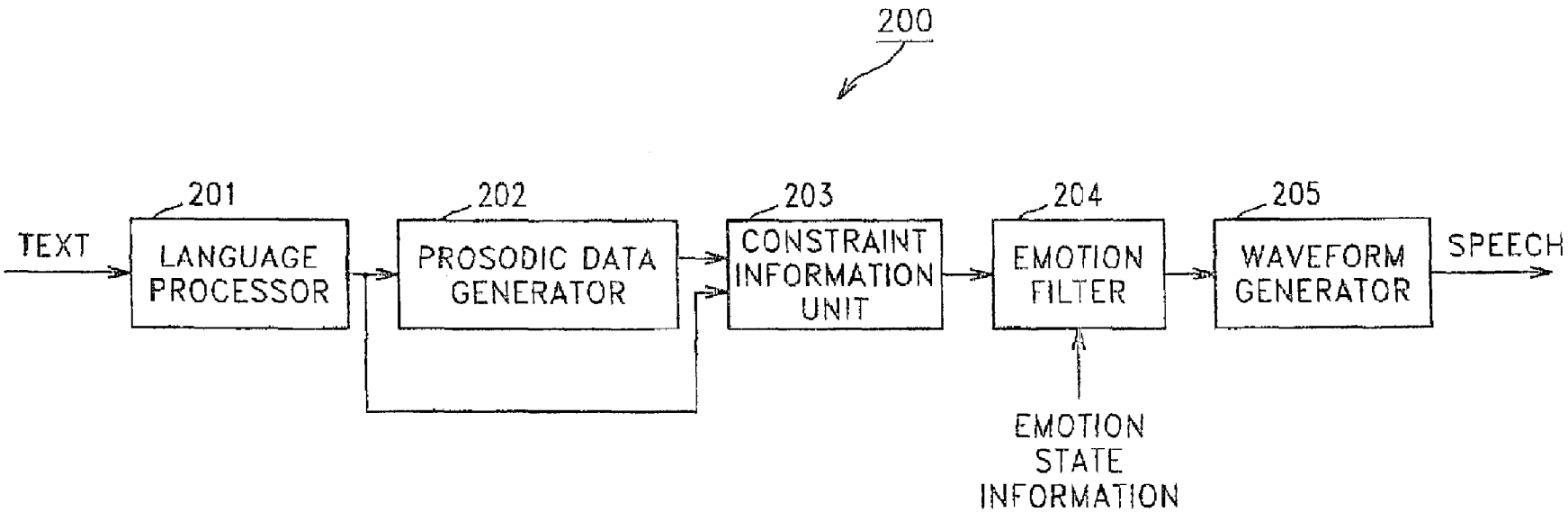
FIG. 2 shows schematics of the speech synthesis method.

FIG. 2 shows schematics of a speech synthesis device 200 of the present embodiment. The speech synthesis device 200 is formed as a text speech synthesis device, made up by a language processor 201, a prosodic data generating unit 202, a constraint information generating unit 203, a emotion filter 204 and a waveform generating unit 205.

The language processor 201 is fed with the text to output a string of pronunciation marks. As the language processor 201, a language processor of a pre-existing speech synthesis device may be used. As an example, the language processor 201 analyzes the text construction, or analyzes the morpheme, based on dictionary data, and subsequently prepares a string of pronunciation symbols, made up by phoneme series, accents or breaks (pause), using the article information, to route the string of pronunciation symbols to the prosodic data generating unit 202. Specifically, when a text reading: 'jaa, doosurebaiinosa' meaning 'then, what may I do?' is input, the language processor 201 generates e.g., a string of pronunciation marks [Ja=7aa,, dooo=7//sure=6ba//ii=3iinosa] to route this string of the pronunciation marks to the prosodic data generating unit 202. Meanwhile, the pronunciation marks are not limited to this example, such that any suitable standardized symbols, such as IPA (International Phonetic Alphabet) or SAMPA (Speech Assessment Methods Phonetic Alphabet), or symbols developed uniquely by an implementer, may be used.

The prosodic data generating unit 202 generates prosodic data, based on the string of pronunciation marks, supplied by the language processor 201, and routes the so prepared prosodic data to the constraint information generating unit 203. As this prosodic data generating unit 202, a prosodic data generating unit of the preexisting speech generating unit may be used. As an example, the prosodic data generating unit 202 generates, by the statistic technique, such as quantification class 1 or method by rules, the prosodic data representing the duration, pitch or loudness of the phoneme in question, using the information such as accent types extracted from the string of pronunciation marks, number of the phonemes in the accent phrase or the sorts of the phonemes. In the case of the above exemplary text, prosodic data shown in the following Table are produced.

TABLE 1

| | | | | | | |
|---|---|---|---|---|---|---|
| J | 100 | 300 | 0 | 441 | 74 | 441 |
| a | 100 | 1860 | | | | |
| a | 100 | 2232 | 75 | 329 | | |
| . | 100 | 1256 | 99 | 302 | | |
| . | 100 | 5580 | | | | |
| d | 100 | 300 | 0 | 310 | | |
| o | 100 | 1488 | 50 | 310 | | |
| o | 100 | 2232 | 50 | 479 | | |
| s | 100 | 651 | | | | |
| u | 100 | 2232 | 50 | 387 | | |
| r | 100 | 837 | | | | |
| e | 100 | 1674 | 80 | 459 | | |
| b | 100 | 1209 | | | | |
| a | 100 | 1488 | 50 | 380 | | |
| i | 100 | 2232 | 80 | 374 | | |
| i | 100 | 2232 | | | | |
| n | 100 | 1860 | 20 | 290 | | |
| s | 100 | 651 | | | | |
| a | 100 | 2232 | | | | |
| . | 100 | 2372 | 99 | 263 | | |

In this Table, '100' next following the phoneme 'J' means the loudness or sound volume (relative intensity) of the phoneme in question. The default value of the sound volume 100, with the sound volume increasing with the increase figure. The next following '300' indicates that the time duration of the phoneme 'J' is 300 samples. The next following '0' and '441' indicates that 441 Hz is reached at a time point of 75% of the sample of the duration of 300 samples. The next following '75' and '441' indicate the frequency of 441 Hz at the time point of 75% of the duration of 300 samples. Although the number of samples is used in the present instance as a unit of the time duration, this again is merely illustrative, such that the unit of the time duration of millisecond may also be used.

The constraint information generating unit 203, fed with the string of pronunciation marks, is designed to impose limitations on the change in the parameters of the prosodic data, based on the information on the position of the accents of the string of pronunciation marks or on the word boundary, lest the contents should become incomprehensible due e.g., to changes in accents. Although the details of the constraint information will be explained in detail later, the information indicating the relative intensity of the phoneme in question is expressed by '1' and '0'. By this, the above-mentioned prosodic data can be rewritten as shown in the following Table 2:

TABLE 2

| | | | | | | |
|---|---|---|---|---|---|---|
| J(0) | 100 | 300 | 0 | 441 | 74 | 441 |
| a(1) | 100 | 1860 | | | | |
| a(0) | 100 | 2232 | 75 | 329 | | |
| .(0) | 100 | 1256 | 99 | 302 | | |
| .(0) | 100 | 5580 | | | | |
| d(0) | 100 | 300 | 0 | 310 | | |
| o(0) | 100 | 1488 | 50 | 310 | | |
| o(1) | 100 | 2232 | 50 | 479 | | |
| s(0) | 100 | 651 | | | | |
| u(0) | 100 | 2232 | 50 | 387 | | |
| r(0) | 100 | 837 | | | | |
| e(1) | 100 | 1674 | 80 | 459 | | |
| b(0) | 100 | 1209 | | | | |
| a(0) | 100 | 1488 | 50 | 380 | | |
| i(1) | 100 | 2232 | 80 | 374 | | |
| i(0) | 100 | 2232 | | | | |
| n(0) | 100 | 1860 | 20 | 290 | | |
| s(0) | 100 | 651 | | | | |
| a(0) | 100 | 2232 | | | | |
| .(0) | 100 | 2372 | 99 | 263 | | |

By adding the constraint information to the prosodic data in this manner, constraint can be imposed lest the relative pitch of the phoneme marked with '0' and that of the phoneme marked with '1' should be reversed in changing the parameters. The constraint information may also be sent to the emotion filter 204, instead of adding the information to the prosodic data itself.

The emotion filter 204, fed with prosodic data, summed with the constraint information in the constraint information generating unit 203, changes the parameters of the prosodic data within the constraint, in accordance with the emotion state information supplied, and routes the so changed prosodic data to the waveform generating unit 205.

It is noted that the emotion state information is the information representing the emotion state of the emotion model of the uttering entity. Specifically, the emotion state information specifies one or more of the states of the emotion model (emotion state) changed responsive to the surrounding environment (extraneous factors) or inner states (inner factors), such as calm, anger, sadness, happiness or comfort.

In the case of the robot apparatus, the information indicating the emotion state, discriminated as described above, is sent to the emotion filter 204.

The emotion filter 204 is responsive to the so supplied emotion state information to control the parameters of the prosodic data. Specifically, a combination table of parameters corresponding to the above-mentioned respective emotions (calm, anger, sadness, happiness or calm) is prepared at the outset and switched responsive to the actual emotions. Although specified instances are shown later as to the tables provided for respective emotions, if the emotion state is anger, the parameters of the above prosodic data are changed as shown in the following Table 3.

TABLE 3

| | | | | | | |
|---|---|---|---|---|---|---|
| J | 145 | 300 | 0 | 711 | 75 | 787 |
| a | 145 | 2975 | | | | |
| a | 115 | 1718 | 75 | 469 | | |
| . | 115 | 967 | 99 | 394 | | |
| . | 115 | 5580 | | | | |
| d | 125 | 300 | 0 | 416 | | |
| o | 125 | 1145 | 50 | 416 | | |
| o | 115 | 1718 | 50 | 788 | | |
| s | 125 | 501 | | | | |
| u | 125 | 1718 | 50 | 580 | | |
| r | 125 | 644 | | | | |
| e | 125 | 2831 | 80 | 816 | | |
| b | 85 | 930 | | | | |
| a | 85 | 1145 | 50 | 551 | | |
| i | 125 | 1718 | 80 | 580 | | |
| i | 135 | 1718 | | | | |
| n | 145 | 644 | | | | |
| s | 145 | 501 | | | | |
| a | 135 | 1718 | | | | |
| . | 125 | 1826 | 99 | 320 | | |

If the emotion state is anger, the sound volume and the pitch are increased on the whole, while the duration of each phoneme is also changed, such that the utterance made is accompanied by the emotion of anger, as shown in Table 3.

The waveform generating unit 205 is fed with prosodic data, summed with the emotion in the emotion filter 204, to output the speech waveform. As this waveform generating unit 205, a waveform generating unit of a pre-existing speech synthesis device may be used. Specifically, the waveform generating unit 205 retrieves, from the large amount of prerecorded speech data, the speech data portion which is as close to the phoneme sequence, pitch and sound volume, as possible, to slice and array the retrieved speech data portion to prepare the speech waveform data.

Figure 3:
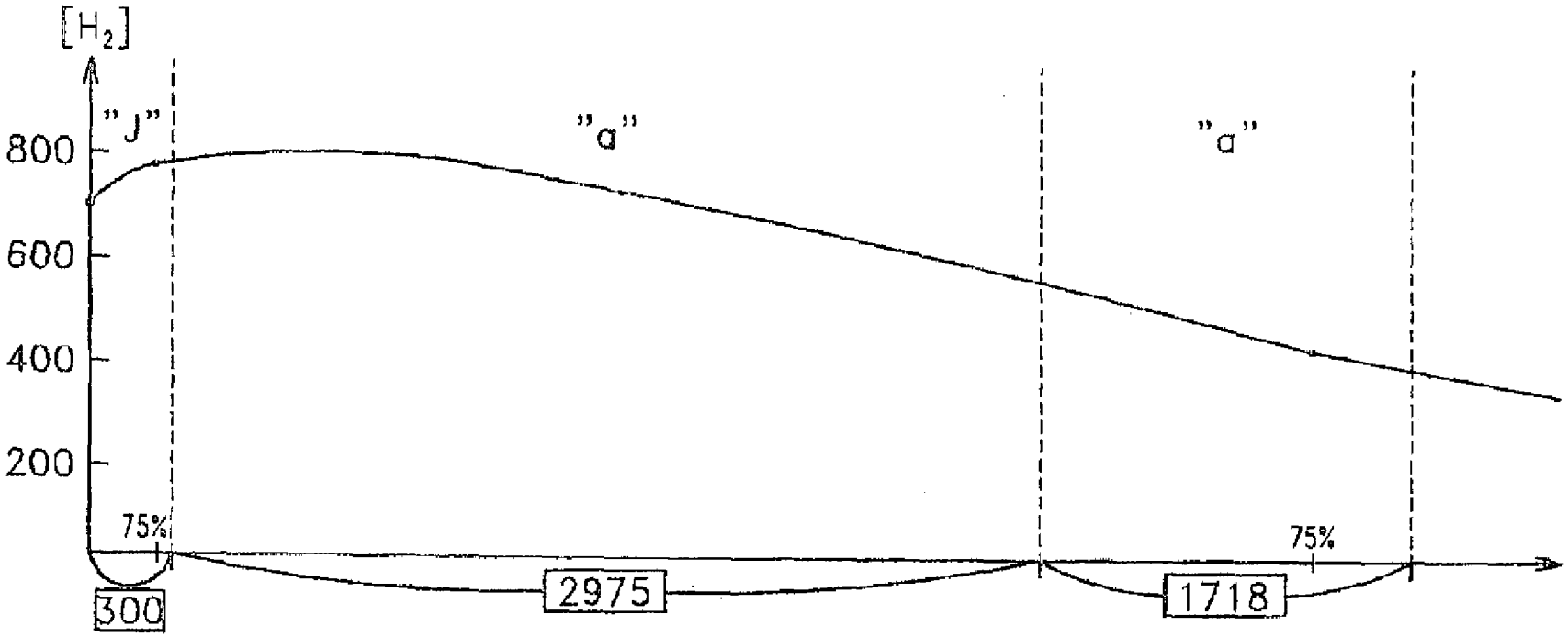
FIG. 3 shows the relation between the duration of each phoneme and the pitch.

The waveform generating unit 205 is also able to prepare speech waveform data by obtaining a continuous pitch pattern by, for example, interpolation, based on the above-described prosodic data. FIG. 3 shows an instance of the continuous pitch pattern in the case of the above-mentioned prosodic data. For simplicity, FIG. 3 shows the continuous pitch pattern which represents the first three phonemes, that is 'J', 'a' and 'a'. Although not shown, the sound volume may also be continuously represented by using fore and aft side values by interpolation.

The produced speech waveform data is sent via D/A converter or amplifier to a loudspeaker from which it is emitted as actual speech.

In accordance with the above-described basic embodiment of the present invention, speech utterance with emotion representation can be made by controlling the parameters for speech synthesis, such as time duration of the phoneme, pitch, sound volume etc, depending on the emotion associated with bodily conditions. Moreover, by adding the constraint condition to the parameters to be changed, the prosodic characteristics of the language in question may be maintained so as not to cause changes in the uttered contents.

The speech synthesis device 200 has been explained as a text speech synthesis device in which the text is input and turned into a string of pronunciation marks before proceeding to prepare prosodic data. This, however, is merely illustrative such that the speech synthesis device may also be constructed as ruled speech synthesis device which is fed with a string of pronunciation marks to prepare prosodic data. It is also possible to directly input prosodic data summed with the constraint information. Moreover, in the speech synthesis device 200, the constraint information generating unit 203 is provided only on the downstream side of the prosodic data generating unit 202. This, however, is not limitative such that the constraint information generating unit 203 may be provided upstream of the prosodic data generating unit 202.

(2) Algorithm of Emotion Addition

The algorithm of adding the emotion to the prosodic data is explained in detail. It is noted that the prosodic data is the data representing the time duration of each phoneme, pitch, sound volume etc, as described above, and can be constructed as shown for example in the following Table 4:

TABLE 4

| | | | | | | | | | | | | |
|---|---|---|---|---|---|---|---|---|---|---|---|---|
| a | 100 | 114 | 2 | 87 | | 79 | 89 | | | | | |
| m | 100 | 81 | 31 | 92 | | | | | | | | |
| E | 100 | 132 | 29 | 97 | 58 | 100 | 92 | 103 | | | | |
| O | 100 | 165 | 10 | 104 | 37 | 102 | 50 | 101 | 65 | 103 | 82 | 104 |
| t | 100 | 41 | 33 | 99 | | | | | | | | |
| O | 100 | 137 | 3 | 109 | 40 | 118 | 75 | 118 | | | | |
| t | 100 | 253 | 4 | 111 | 26 | 108 | 47 | 105 | 70 | 102 | 93 | 99 |
| E | 100 | 125 | 23 | 97 | 94 | 87 | 90 | | | | | |

It is noted that this prosodic data has been created from the text reading: 'Amewo totte' meaning 'take starch jelly'.

In the above Table, '100' next to the phoneme 'a' indicates the sound volume (relative intensity) of this phoneme. Meanwhile, the default value of the sound volume is 100, with the sound volume increasing with an increasing figure. The next following '114' indicates that the duration of the phoneme 'a' is 114 ms, while the next following '2' and '87' indicate that 87 Hz is reached at 2% of the time duration of 114 ms. The next following '79' and '89' indicate that 89 Hz is reached at 79% of the duration of 114 ms. In this manner, the totality of the phonemes may be represented.

By the prosodic data being changed in keeping with the respective emotion representations, the uttered text may be tuned to the emotion expression. Specifically, the time duration, pitch, sound volume etc, as parameters indicating the personalities or characteristics of the phoneme, are modified for emotion expression.

(2-2) Generation of Constraint Information

In Japanese, it is crucial which phoneme is to be accentuated. In the above text reading: 'Amewo totte', the accent core is at the position 'to', with the accent type being the so-called 1 type. On the other hand, the accent phrase 'amewo' is 0 type, that is flat type, there being accents at none of the phonemes. Thus, if the parameter is to be changed for emotion representation, this accent type needs to be maintained, otherwise the meaning of the sentence is not transmitted. That is, there is a risk that 'totte' meaning 'take' as the 1 type is changed in intonation such that it may be taken for 'totte' as the 0 type, meaning 'handle', and that 'amewo', as the 0 type, meaning 'jelly starch', is changed in intonation such that it may be taken for 'amewo', as the 1 type, meaning 'rain'.

Thus, the information indicating the relative pitch of the phoneme is represented by '1' and '0'. The above prosodic data can then be rewritten as indicated in the following Table 5:

TABLE 5

| | | | | | | | | | | | | |
|---|---|---|---|---|---|---|---|---|---|---|---|---|
| a(0) | 100 | 114 | 2 | 87 | 79 | | 89 | | | | | |
| m(0) | 100 | 81 | | 31 | 92 | | | | | | | |
| E(0) | 100 | 132 | | 29 | 97 | 58 | 100 | 92 | 103 | | | |
| O(0) | 100 | 165 | 10 | 104 | 37 | 102 | 50 | 101 | 65 | 103 | 82 | 104 |
| t(1) | 100 | 41 | 33 | 99 | | | | | | | | |
| O(1) | 100 | 137 | | 3 | 109 | 40 | 118 | 75 | 118 | | | |
| t(0) | 100 | 253 | 4 | 111 | 26 | 108 | 47 | 105 | 70 | 102 | 93 | 99 |
| E(0) | 100 | 125 | 23 | 97 | 94 | 87 | 90 | | | | | |

By adding the constraint information to the prosodic data, the constraint information can be added, in changing the parameters, so that the relative intensity of the phoneme marked with '0' and that marked with '1' are not interchanged, that is so that the accent core position is not changed.

It is noted that the constraint information for specifying the accent core position is not limited to this instance, and may be so formulated that the information indicating whether or not the phoneme in question is to be accentuated is indicated as '1' and '0', with the phoneme being lowered in pitch between '1' and the next '0'. In such case, the above Table is rewritten as follows:

TABLE 6

| | | | | | | | | | | | | |
|---|---|---|---|---|---|---|---|---|---|---|---|---|
| a(0) | 100 | 114 | 2 | 87 | 79 | 89 | | | | | | |
| m(1) | 100 | 81 | 31 | 92 | | | | | | | | |
| E(1) | 100 | 132 | 29 | 97 | 58 | 100 | 92 | 103 | | | | |
| O(1) | 100 | 165 | 10 | 104 | 37 | 102 | 50 | 101 | 65 | 103 | 82 | 104 |
| t(1) | 100 | 41 | 33 | 99 | | | | | | | | |
| O(1) | 100 | 137 | 3 | 109 | 40 | 118 | 75 | 118 | | | | |
| t(0) | 100 | 253 | 4 | 111 | 26 | 108 | 47 | 105 | 70 | 102 | 93 | 99 |
| E(0) | 100 | 125 | 23 | 97 | 94 | 87 | 90 | | | | | |

Meanwhile, if the time length of the phoneme 'o' in the above 'totte', meaning 'take', it may be transmitted incorrectly as 'tootte', meaning 'through'. So, the information for distinguishing the long vowel from the short vowel may be added to the prosodic data.

It is assumed that the threshold value of the time duration used for distinguishing the long vowel and the short vowel of the phoneme 'o' from each other is 170 ms. That is, the phoneme 'o' is defined to be a short vowel 'o' and a long vowel 'oo' for the time duration up to 170 ms and for the time duration exceeding 170 ms, respectively.

In this case, the prosodic data for synthesizing a word 'tootte' meaning 'through', is represented as shown in the following Table 7:

TABLE 7

| | | | | | | | | | | | | | | | | |
|---|---|---|---|---|---|---|---|---|---|---|---|---|---|---|---|---|
| t | 100 | 34 | 50 | 112 | | | | | | | | | | | | |
| O | 100 | 282 | (>170) | 2 | 116 | 19 | 119 | 37 | 119 | 49 | 113 | 55 | 110 | 67 | 106 | 99 | 101 |
| t | 100 | 288 | 99 | 93 | | | | | | | | | | | | |
| E | 100 | 139 | 8 | 92 | 41 | 92 | 77 | 90 | | | | | | | | |

As may be seen from this Table 7, the time duration of the phoneme 'o' is characteristically different from that in the case of the prosodic data 'totte'. In addition, there is added the constraint information that the time duration of the phoneme 'o' must exceed 170 ms.

The problem as to whether a given phoneme is a short vowel or a long vowel presents itself only when the difference is essential in discriminating the meaning. For example, there is no marked difference, in deciding on the meaning, between 'motto', meaning 'more', with the phoneme 'mo' being a short vowel, and 'mootto', similarly meaning 'more' with the phoneme 'moo' being a long vowel. Rather, the emotion can be added by using 'mootto' in place of 'motto'. Thus, if the time duration of synthesizing 'motto' with a talking manner as rapid as possible, without giving rise to extraneous emotion, is min, and the time duration of synthesizing 'mootto' is max, the range of the time duration may be added as the constraint information, as shown in the following Table 8:

TABLE 8

| | | | | | | | | |
|---|---|---|---|---|---|---|---|---|
| m | 100 | 74 (min40, max90) | 39 | 116 | 95 | 109 | | |
| O | 100 | 118 (min52, max235) | 32 | 108 | 97 | 107 | | |
| t | 100 | 261 (min201, max370) | 32 | 103 | 58 | 99 | 89 | 97 |
| O | 100 | 131 (min111, max153) | 33 | 93 | 57 | 92 | 87 | 85 |

It is noted that the constraint information to be added to the prosodic data is not limited to the above-described embodiment, such that there may be added variegated information necessary for maintaining the prosodic characteristics of the language in question.

For example, constraint information for maintaining the parameters of said prosodic data in a portion containing said prosodic features may be added. Also, constraint information for maintaining the magnitude relation, difference or ratio of the parameter values in the portion containing said prosodic features may be added. Further, constraint information for maintaining said parameter value in the portion containing said prosodic features within a predetermined range may be added.

It is also possible to provide the constraint information generating unit upstream of the prosodic data generating unit 202 to add the constraint information to the string of the pronunciation marks. Taking the case of 'haI', which is the string of pronunciation marks of a sword 'hai', it is the same for 'hai', meaning 'yes', used in replying to a naming or in making an affirmative reply, and for 'hai?' meaning 'yes?' used in making re-inquiry or expressing an anxious emotion to what has been said. However, the two differ as to the sound tone pattern at the prosodic phrase boundary. That is, the former is read with a falling intonation, while the latter is read with a rising intonation. Since the sound tone pattern at the prosodic phrase boundary in speech synthesis is realized by the relative pitch height, the risk is high that the speaker's intention is not imparted to the hearer in case the pitch height is changed.

Thus, the constraint information generating unit at an upstream side of the prosodic data generating unit 202 may add the constraint information 'hal(H)' and 'hal(L)' for the 'hai' read with a rising intonation and for the 'hai' read with a falling intonation, respectively.

Turning to an instance of English, a word 'English teacher' has different meanings depending on whether the stress is on 'English' or on 'teacher'. That is, if the stress is on 'English', the word means 'a teacher on English', whereas, if the stress is on the 'teacher', it means a 'teacher of an Englishman'.

Thus, the constraint information generating unit on the upstream side of the prosodic data generating unit 202 may add the constraint information to the pronunciation marks 'IN-glIS ti:-tS@r' for the 'English teacher' for distinguishing the two.

Specifically, the stressed word may be encircled by [ ] such that '[IN-gllS]ti:ts@r' and 'IN-glIS [ti:tS@r]' stand for the 'English teacher' meaning 'a teacher of English' and for 'English teacher' meaning 'a teacher of an Englishman', respectively.

If the constraint information is added to the string of pronunciation marks in this manner, the prosodic data generating unit 202 may generate prosodic data as usual and modify the parameters in the emotion filter 204 so as not to change the prosodic pattern of the prosodic data.

(2-3) Parameters Accorded Responsive to Respective Emotions

By controlling the above parameters responsive to the emotions, emotion expressions can be imparted to the uttered text. The emotions represented by the uttered text include calm, anger, sadness, happiness and comfort. These emotion are given only by way of illustration and not by way of limitation.

Figure 4:
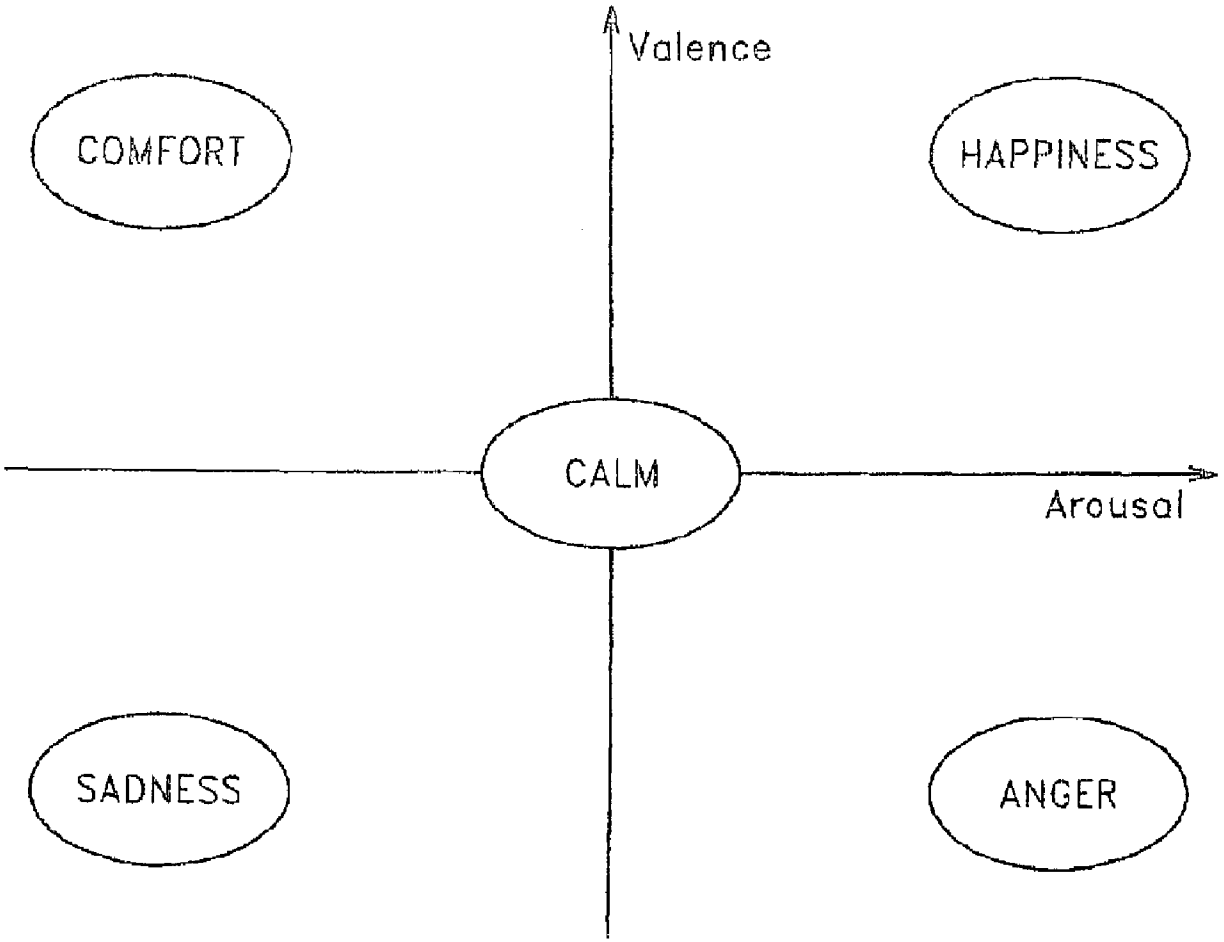
FIG. 4 shows the relation among the emotion classes in a characteristic plane or in an operative plane.

For example, the above emotion may be represented in a characteristic space having arousal and valence as elements. For example, in FIG. 4, areas for anger, sadness, happiness and comfort may be constructed in the characteristic space having arousal and valence as elements, with the area of calm being constructed at the center. For example, the anger is arousal and represented as being negative, while the sadness is not arousal and represented as being negative.

The following tables 9 to 13 show combination tables for parameters (at least the duration of the phoneme (DUR), pitch (PITCH) and sound volume (VOLUME), predetermined in association with respective emotions of anger, sadness, happiness and comfort. These tables are generated at the outset based on the characteristics of the respective emotions.

TABLE 9

CARM

| PARAMETERS | STATE OR VALUE |
|---|---|
| LASTWORDACCENTED | No |
| MEANPITCH | 280 |
| PITCHVAR | 10 |
| MAXPITCH | 370 |
| MEANDUR | 200 |
| DURVAR | 100 |
| PROBACCENT | 0.4 |
| DEFAULTCONTOUR | rising |
| CONTOURLASTWORD | rising |
| VOLUME | 100 |

TABLE 10

ANGER

| PARAMETERS | STATE OR VALUE |
|---|---|
| LASTWORDACCENTED | No |
| MEANPITCH | 450 |
| PITCHVAR | 100 |
| MAXPITCH | 500 |
| MEANDUR | 150 |
| DURVAR | 20 |
| PROBACCENT | 0.4 |
| DEFAULTCONTOUR | falling |
| CONTOURLASTWORD | falling |
| VOLUME | 140 |

TABLE 11

SADNESS

| PARAMETERS | STATE OR VALUE |
|---|---|
| LASTWORDACCENTED | Nill |
| MEANPITCH | 270 |
| PITCHVAR | 30 |
| MAXPITCH | 250 |
| MEANDUR | 300 |
| DURVAR | 100 |
| PROBACCENT | 0 |
| DEFAULTCONTOUR | falling |
| CONTOURLASTWORD | falling |
| VOLUME | 90 |

TABLE 12

COMFORT

| PARAMETERS | STATE OR VALUE |
|---|---|
| LASTWORDACCENTED | T |
| MEANPITCH | 300 |
| PITCHVAR | 50 |
| MAXPITCH | 350 |
| MEANDUR | 300 |
| DURVAR | 150 |
| PROBACCENT | 0.2 |
| DEFAULTCONTOUR | rising |
| CONTOURLASTWORD | rising |

TABLE 12-continued

| COMFORT | |
|---|---|
| PARAMETERS | STATE OR VALUE |
| VOLUME | 100 |

TABLE 13

| HAPPINESS | |
|---|---|
| PARAMETERS | STATE OR VALUE |
| LASTWORDACCENTED | T |
| MEANPITCH | 400 |
| PITCHVAR | 100 |
| MAXPITCH | 600 |
| MEANDUR | 170 |
| DURVAR | 50 |
| PROBACCENT | 0.3 |
| DEFAULTCONTOUR | rising |
| CONTOURLASTWORD | rising |
| VOLUME | 120 |

By switching the tables comprised of the parameters associated with the respective emotions, provided at the outset, depending on the actually discriminated emotions, and by changing the parameters based on these tables, speech utterance tuned to emotion is achieved.

Specifically, the technique described in the specification and drawings of European Patent Application 01401880.1 maybe used.

For example, the pitch of each phoneme is shifted so that the average pitch of the phoneme contained in the uttered words will be of the value of the MEANPITCH and so that the variance of the pitch will be of the value of the PITCHVAR.

Similarly, the duration of each phoneme contained in a word uttered is shifted so that the mean duration of the phonemes is equal to MEANDUR. Also, the variance of the duration is controlled so as to be DURVAR. As for the phonemes to which the constraint information has been added in connection with the vale of the duration and its range, changes within the constraint are made. This prevents such a situation in which the short vowel is mistaken for long vowel in transmission.

The sound volume of each phoneme is controlled to a value specified by the VOLUME in each emotion table.

It is also possible to change the contour of each accent phrase based on this table. That is, if DEFAULTCONTOUR=rising, the pitch inclination of the accent phrase is of the rising intonation, whereas, if DEFAULTCONTOUR=falling, the pitch inclination of the accent phrase is of the falling intonation. For example, in the text example 'Amewo totte', the constraint condition is set that the accent core is at the phoneme 'to' and that the pitch must be lowered between the phonemes 't', 'o' and 't', 'e', so that, if DEFAULTCONTOUR=rising, only the pitch tilt becomes smaller to such an extent that the pitch can be lowered subsequently at the position in question.

By the speech synthesis employing the table parameters, selected responsive to the emotion, there is generated an uttered text tuned to the emotion expression.

A robot apparatus, embodying the present invention, is now explained, and the manner of mounting the above-described uttering algorithm to this robot apparatus is then explained.

In the present embodiment, the control of the parameters responsive to the emotion is realized by switching the tables comprised of parameters provided at the outset in association with the emotions. However, the parameter control is, of course, not limited to this particular embodiment.

(3) Specified Instance of a Robot Apparatus of the Present Embodiment

As a specified embodiment of the present invention, an instance of applying the present invention to a two-legged autonomous robot is explained in detail by referring to the drawings. The emotion/instinct model is introduced into the software of the humanoid robot to enable the robot to perform the behavior more approximate to that of the human being. Although the robot of the present embodiment executes the actual behavior, utterance may be achieved using a computer system having a loudspeaker to perform a function effective in the man-machine interaction or dialog. Consequently, the application of the present invention is not limited to the robot system.

Figure 5:
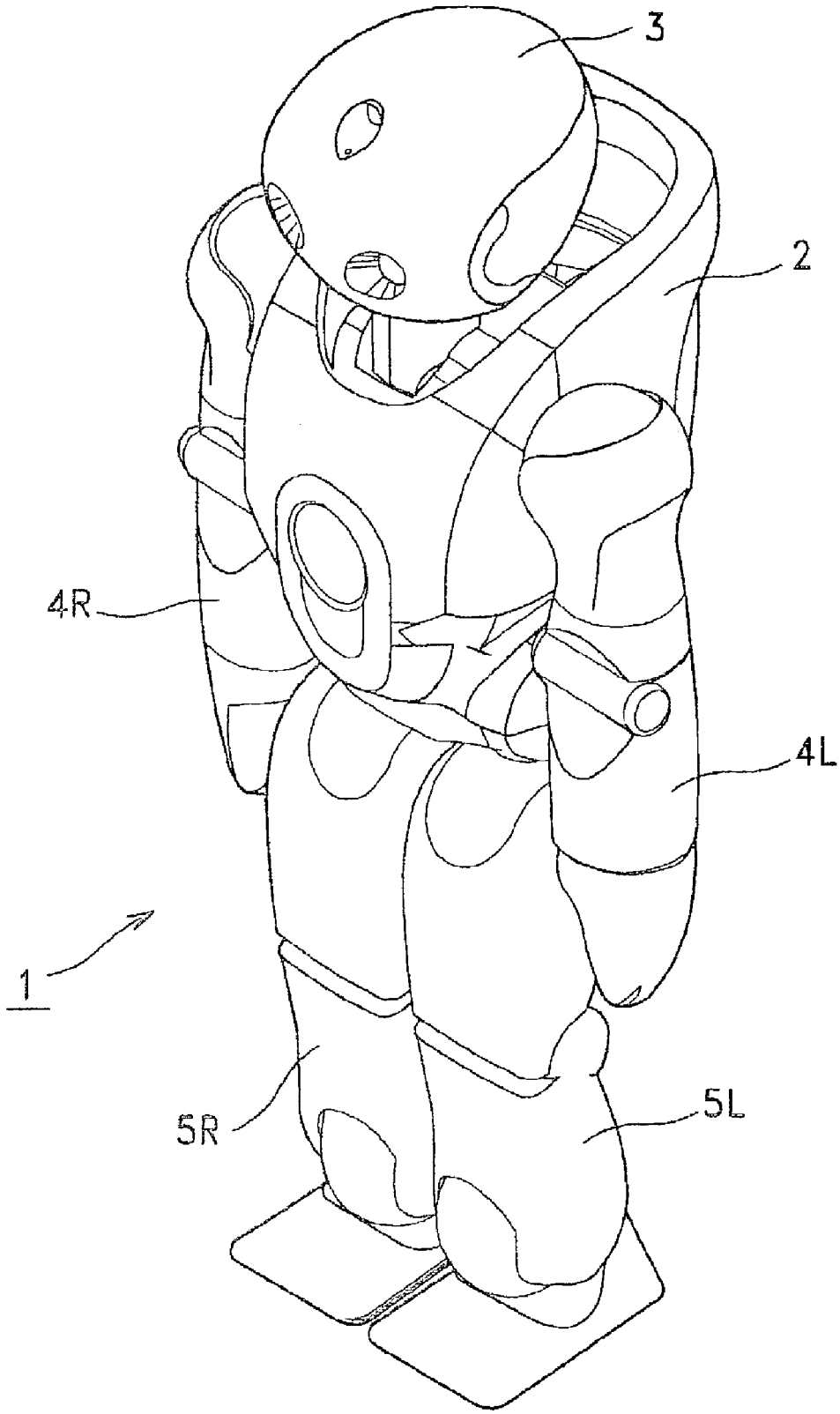
FIG. 5 is a perspective view showing the appearance of the robot apparatus.

The robot apparatus, shown as a specified embodiment in FIG. 5, is a practically useful robot, supporting the human activities in various aspects of our everyday life, such as in the living environment. Additionally, it is an entertainment robot that is capable of behaving responsive to the internal state (anger, sadness, happiness or entertainment) and of expressing basic human performances.

In a robot apparatus 1, shown in FIG. 5, a head unit 3 is connected to a preset position of a body trunk unit 2. In addition, right and left arm units 4R/L and right and left leg units 5R/L are connected to the body trunk unit 2. R, L denote suffices which stand for right and left, hereinafter the same.

Figure 6:
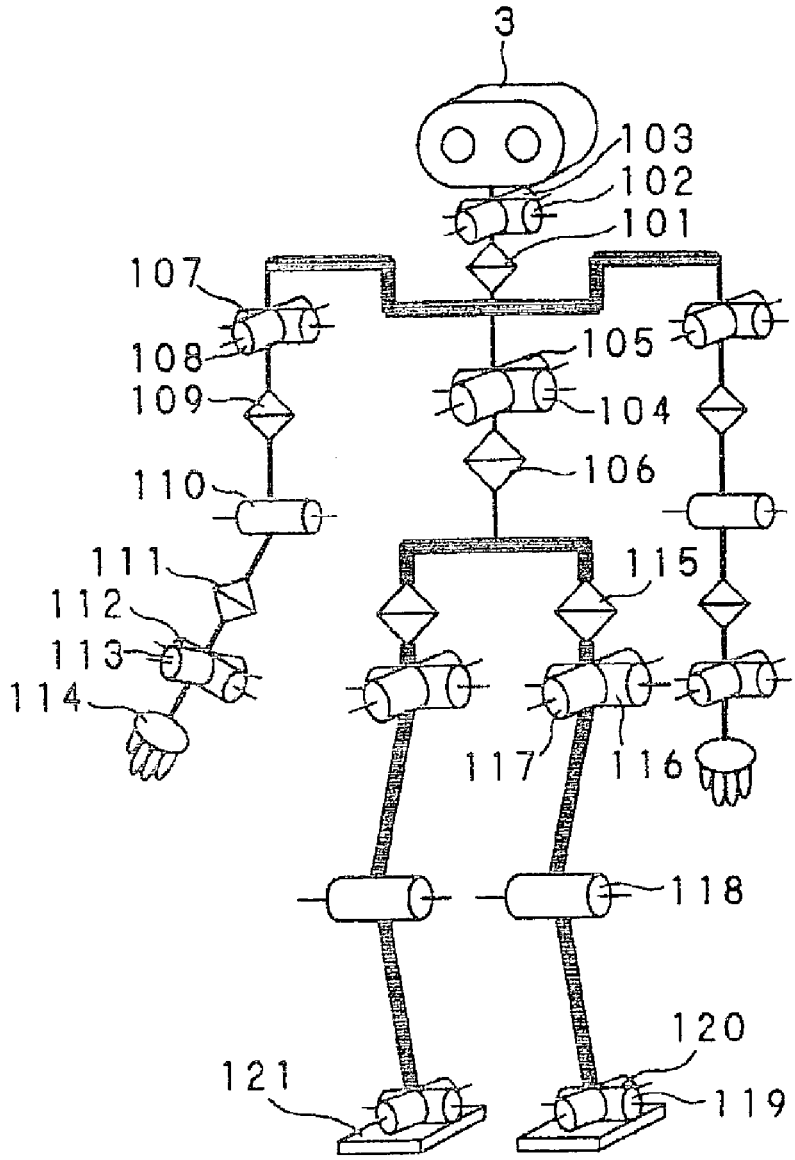
FIG. 6 schematically shows a freedom degree forming model of the robot apparatus.

The joint freedom degree structure of the robot apparatus 1 is shown schematically in FIG. 6. The neckjoint, supporting the head unit 3, has three degrees of freedom, namely a neck joint yaw axis 101, a neck joint pitch axis 102, and a neck joint roll axis 103.

The arm units 4R/L, forming upper limbs, is made up by a shoulder joint pitch axis 107, a shoulder joint roll axis 108, an upper arm yaw axis 109, a hinge joint pitch axis 110, a forearm yaw axis 111, a wrist joint pitch axis 112, a wrist joint roll axis 113 and a hand 114. The hand 114 is, in effect, a multi-joint multi-freedom-degree structure having plural fingers. However, since the operation of the hand 114 has only negligible contribution or effect as concerns the orientation or walking control of the robot apparatus 1, the hand 114 is assumed in the present specification to be of a zero degree of freedom. Thus, each arm has seven degrees of freedom.

On the other hand, the body trunk unit 2 has three degrees of freedom of a body trunk pitch axis 104, a body trunk roll axis 105 and a body trunk yaw axis 106.

The leg units 5R/L, forming the lower limb, is made up by the hip joint yaw axis 115, a hip joint pitch axis 116, a hip joint roll axis 117 , a knee joint pitch axis 118, an ankle joint pitch axis 119, a ankle joint roll axis 120 and a foot 121. In the present specification, the point of intersection of the hipjoint pitch axis 116 and the hip joint roll axis 117 defines the hip joint position of the robot apparatus 1. The foot 121 of the human body is, in effect, a multi-joint multi-freedom-degree structure including foot soles. However, the foot sole of the robot apparatus 1 is of the zero degree of freedom. Consequently, each leg is constructed by six degrees of freedom.

In sum, the robot apparatus 1 in its entirety has $3+7\times2+3+6\times2=32$degrees of freedom. However, the entertainment-oriented robot apparatus 1 is not necessarily limited to 32 degrees of freedom. Of course, the degree of freedom, that is, the number of articulations, can be optionally increased or decreased, depending on the conditions of designing or creation constraint or desired design parameters.

In actuality, the respective degrees of freedom, owned by the robot apparatus 1, are mounted using an actuator. In light of the demand for excluding redundant bulging in appearance for approximation to the human body and for exercising orientation control for an unstable structure of walking on two legs, the actuator is desirably small-sized and lightweight.

Figure 7:
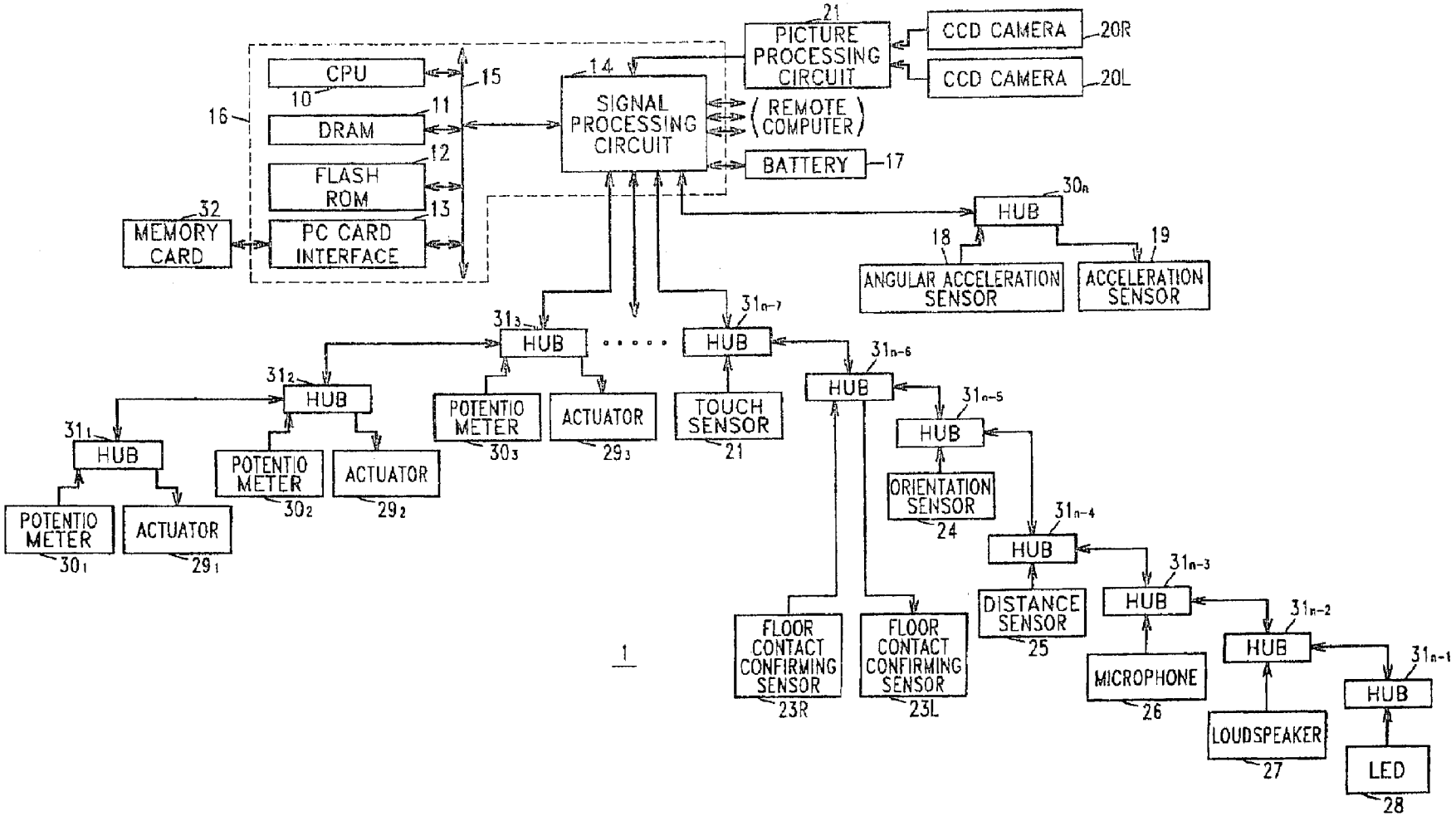
FIG. 7 is a block diagram showing a circuit structure of the robot apparatus.

The control system structure of the robot apparatus 1 is shown schematically in FIG. 7, in which the body trunk unit 2 includes a controller 16 and a battery 17 as a power supply of the robot apparatus 1. The controller 16 is constructed by an interconnection of a CPU (central processing unit) 10, a DRAM (dynamic random access memory) 11, a flash ROM (read-only memory) 12, a PC (personal computer) card interfacing circuit 13 and a signal processing circuit 14 over an internal bus 15. In the body trunk unit 2, there are contained an acceleration sensor 18 and an acceleration sensor 19 for detecting the orientation or movement of the robot apparatus 1.

Within the head unit 3, there are arranged, at preset positions, a CCD (charge coupled device) camera 20 R/L, equivalent to left and right eyes for imaging outside states, an image processing circuit 21 for creating stereo picture data based on the CCD camera 20R/L, a touch sensor 22 for detecting the pressure caused by physical actions such as 'stroking' or 'padding' from the user, a ground contact sensor 23R/L for detecting whether or not the foot sole of the leg units 5R/L has touched the floor, an orientation sensor 24 for measuring the orientation, a distance sensor 25 for measuring the distance to an object lying ahead, a microphone 26 for collecting extraneous sound, a loudspeaker 27 for outputting the sound, such as whining, and an LED (light emitting diode) 28.

The floor contact sensor 23R/L is formed by a proximity sensor or a micro-switch, mounted on the foot sole. The orientation sensor 24 is formed by e.g., the combination of an acceleration sensor and a gyro sensor. Based on the output of the ground contact sensor 23R/L, it can be discriminated, during movements, such as walking or running, whether the left and right leg units 5R/L are in the pronking state or in the bounding state. The tilt or orientation of the body trunk portion can be detected based on an output of the orientation sensor 24.

In connecting portions of the body trunk unit 2, arm units 4R/L and leg units 5R/L, there are provided a number of actuators $\mathbf{29}_1$ to $\mathbf{29}_n$ and a number of potentiometers $\mathbf{30}_1$ to $\mathbf{30}_n$ both corresponding to the number of the degree of freedom of the connecting portions in question. For example, the actuators $\mathbf{29}_1$ to $\mathbf{29}_n$ include servo motors. The arm units 4R/L and the leg units 5R/L are controlled by the driving of the servo motors to transfer to targeted orientation or operations.

The sensors, such as the angular velocity sensor 18, acceleration sensor 19, touch sensor 21, floor contact sensors 23R/L, orientation sensor 24, distance sensor 25, microphone 26, loudspeaker 27 and the potentiometers $\mathbf{30}_1$ to $\mathbf{30}_n$, the LEDs 28 and the actuators $\mathbf{29}_1$ to $\mathbf{29}_n$ are connected via associated hubs $\mathbf{31}_1$ to $\mathbf{31}_n$ to the signal processing circuit 14 of the controller 16, while the battery 17 and the signal processing circuit 21 are connected directly to the signal processing circuit 14.

The signal processing circuit 14 sequentially captures sensor data, picture data or speech data, furnished from the above-mentioned respective sensors, to cause the data to be sequentially stored over internal bus 15 in preset locations in the DRAM 11. In addition, the signal processing circuit 14 sequentially captures residual battery capacity data indicating the residual battery capacity supplied from the battery 17 to store the data in preset locations in the DRAM 11.

The respective sensor data, picture data, speech data and the residual battery capacity data, thus stored in the DRAM 11, are subsequently utilized when the CPU 10 performs operational control of the robot apparatus 1.

In actuality, in an initial stage of power up of the robot apparatus 1, the CPU 10 reads out a memory card 32 loaded in a PC card slot, not shown, of the trunk unit 2, or a control program stored in a flash ROM 12, either directly or through a PC card interface circuit 13, for storage in the DRAM 11.

The CPU 10 then verifies its own status and surrounding statuses, and the possible presence of commands or actions from the user, based on the sensor data, picture data, speech data or residual battery capacity data, sequentially stored from the signal processing circuit 14 to the DRAM 11.

The CPU 10 also determines the next ensuing actions, based on the verified results and on the control program stored in the DRAM 11, while driving the actuators $\mathbf{29}_1$ to $\mathbf{25}_n$, as necessary, based on the so determined results, to produce behaviors, such as swinging the arm units 4R/L in the up-and-down direction or in the left-and-right direction, or moving the leg units 5R/L for walking or jumping.

The CPU 10 generates speech data as necessary and sends the so generated data through the signal processing circuit 14 as speech signals to the loudspeaker 27 to output the speech derived from the speech signals to outside or turns on or flicker the LEDs 28.

In this manner, the present robot apparatus 1 is able to behave autonomously responsive to its own status and surrounding statuses, or to commands or actions from the user.

(3B2) Software Structure of Control Program

The robot apparatus 1 is able to behave autonomously responsive to the internal state. An illustrative software structure of the control program in the robot apparatus 1 is now explained with reference to FIGS. 8 to 13. Meanwhile, this control program is pre-stored in the flash ROM 12 and is read out at an early time on power up of the robot apparatus 1.

Figure 8:
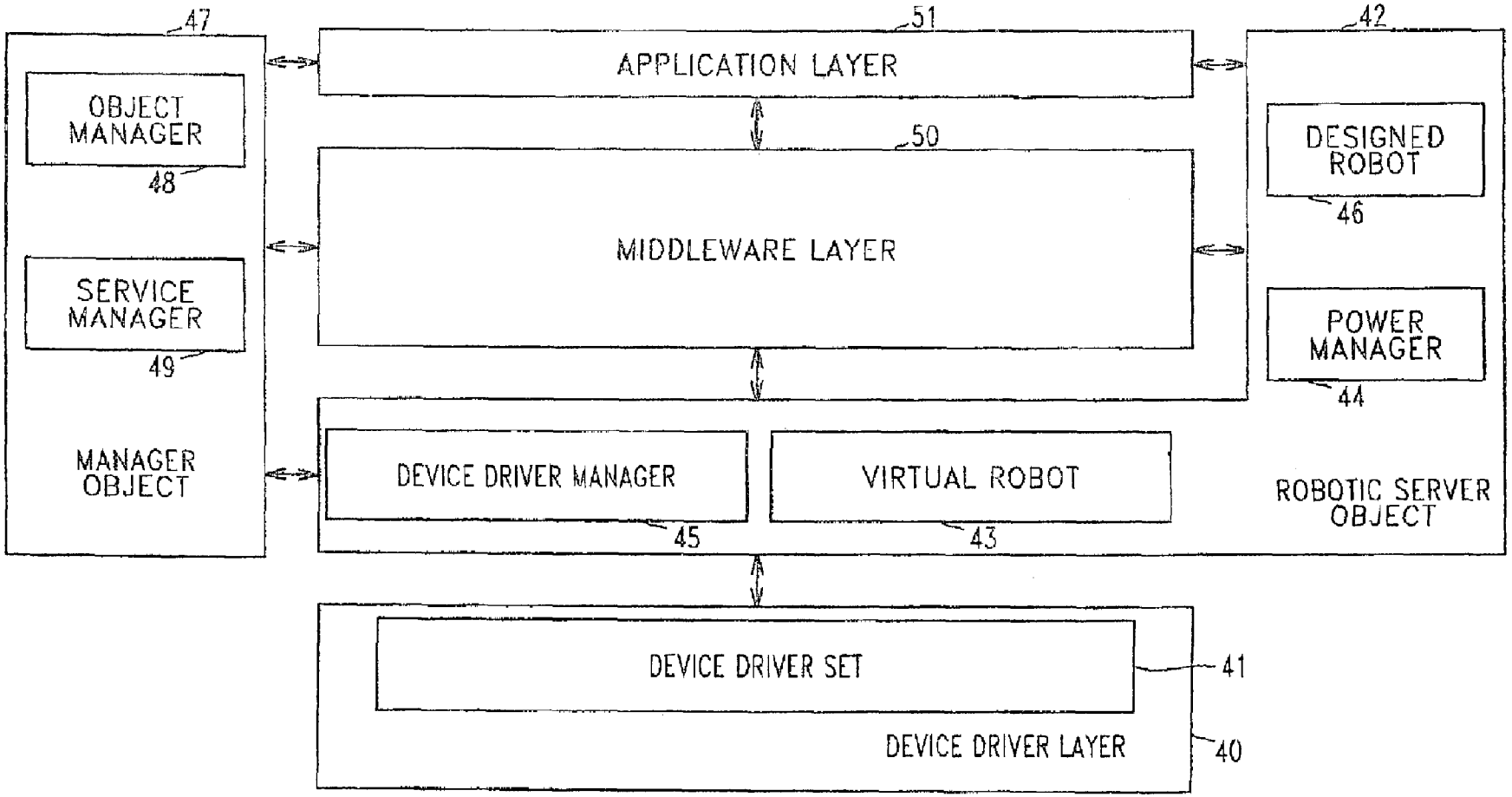
FIG. 8 is a block diagram showing the software structure of the robot apparatus.

In FIG. 8, the device driver layer 40 is located at the lowermost layer of the control program and is comprised of a device driver set 41 made up by plural device drivers. In this case, the device drivers are objects allowed to directly access the hardware used in ordinary computers, such as CCD cameras or timers, and effectuate the processing responsive to an interrupt from the associated hardware.

A robotics server object 42 is located in the lowermost layer of the device driver layer 40 and is comprised of a virtual robot 43, made up of plural software furnishing an interface for accessing the hardware, such as the aforementioned various sensors or actuators $\mathbf{28}_1$ to $\mathbf{28}_n$, a power manager 44, made up of a set of software for managing the switching of power sources, a device driver manager 45, made up of a set of software for managing other variable device drivers, and a designed robot 46 made up of a set of software for managing the mechanism of the robot apparatus 1.

A manager object 47 is comprised of an object manager 48 and a service manager 49. It is noted that the object manager 48 is a set of software supervising the booting or termination of the sets of software included in the robotics server object 42, middleware layer 50 and in the application layer 51. The service manager 49 is a set of software supervising the connection of the respective objects based on the connection information across the respective objects stated in the connection files stored in the memory card.

The middleware layer 50 is located in an upper layer of the robotics server object 42, and is made up of a set of software furnishing the basic functions of the robot apparatus 1, such as picture or speech processing. The application layer 51 is located at an upper layer of the middleware layer 50 and is made up of a set of software for determining the behavior of the robot apparatus 1 based on the results of processing by the software sets forming the middleware layer 50.

Figure 9:
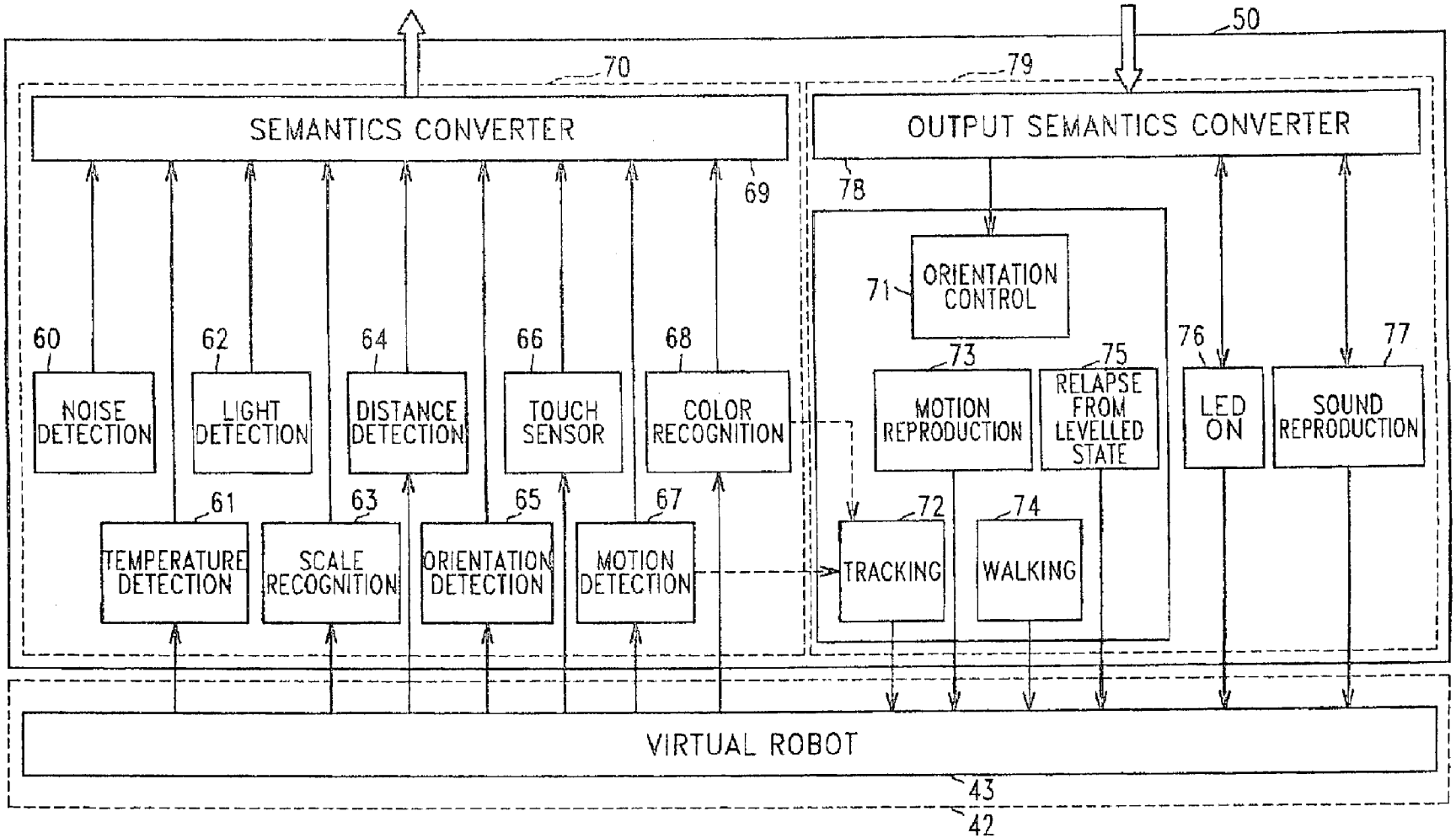
FIG. 9 is a block diagram showing the structure of a middle ware layer in the software structure of the robot apparatus.

FIG. 9 shows a specified software structure of the middleware layer 50 and the application layer 51.

In FIG. 9, the middleware layer 50 includes a recognition system 70, provided with processing modules 60 to 68 for detecting the noise, temperature, lightness, sound scale, distance, orientation, touch sensing, motion detection and color recognition and with an input semantics converter module 69, and an outputting system 79, provided with an output semantics converter module 78 and with signal processing modules 71 to 77 for orientation management, tracking, motion reproduction, walking, restoration of leveling, LED lighting and sound reproduction.

The processing modules 60 to 68 of the recognition module 70 capture data of interest from sensor data, picture data and speech data read out from a DRAM 11 (FIG. 2) by the virtual robot 43 of the robotics server object 42 and perform preset processing based on the so captured data to route the processed results to the input semantics converter module 69. It is noted that the virtual robot 43 is designed and constructed as a component portion responsible for signal exchange or conversion in accordance with a preset communication protocol.

Based on these results of the processing, supplied from the processing modules 60 to 68, the input semantics converter module 69 recognizes its own status and the status of the surrounding environment, such as "noisy", "hot", "light", "a ball detected", "leveling down detected", "patted", "hit", "sound scale of do, mi and so heard", "a moving object detected", or "an obstacle detected", or the commands or actions from the user, and outputs the recognized results to the application layer 41.

Figure 10:
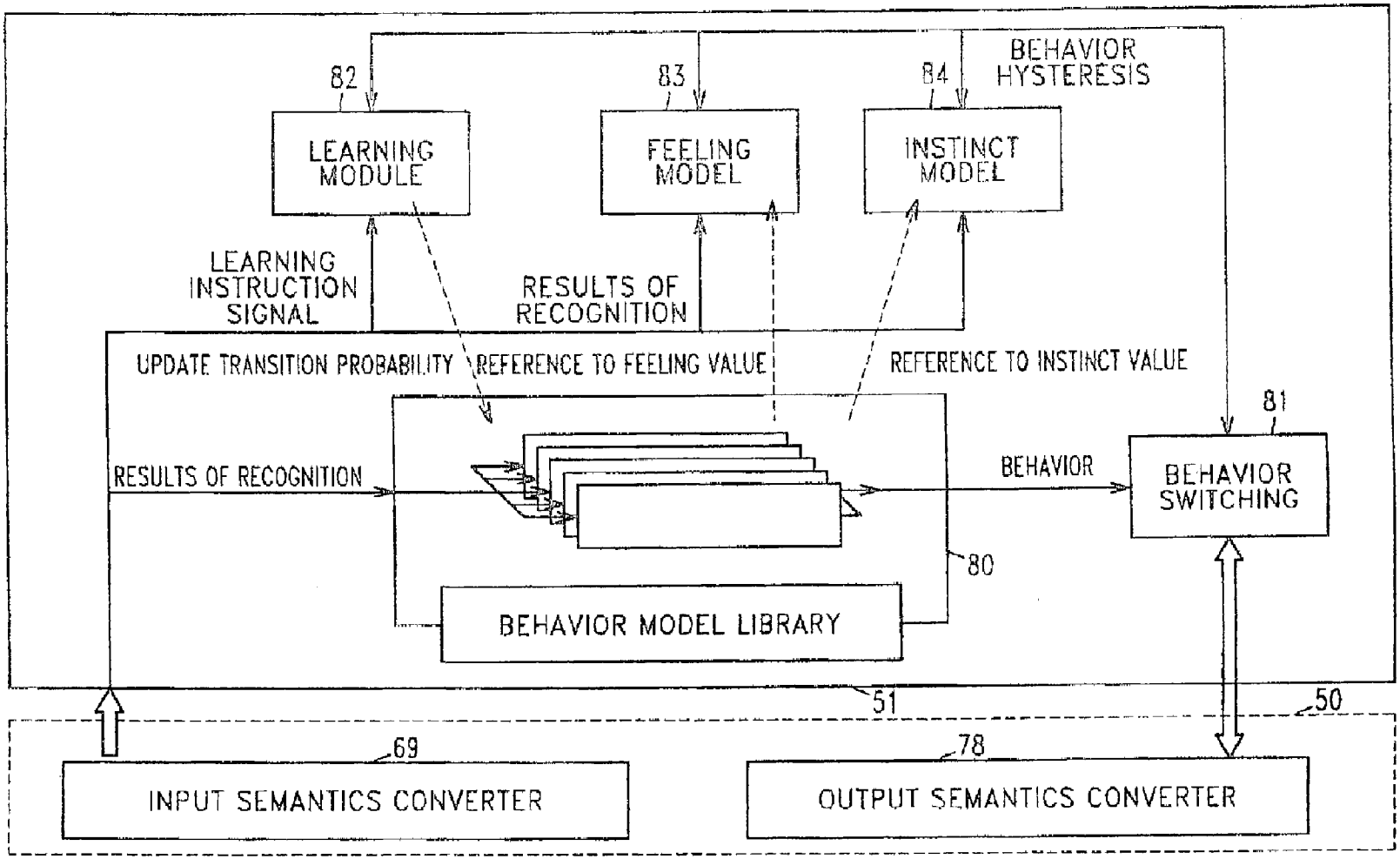
FIG. 10 is a block diagram showing the structure of the application layer in the software structure of the robot apparatus.

The application layer 51 is made up of five modules, namely a behavioral model library 80, a behavior switching module 81, a learning module 82, an emotion model 83, and an instinct model 84, as shown in FIG. 10.

Figure 11:
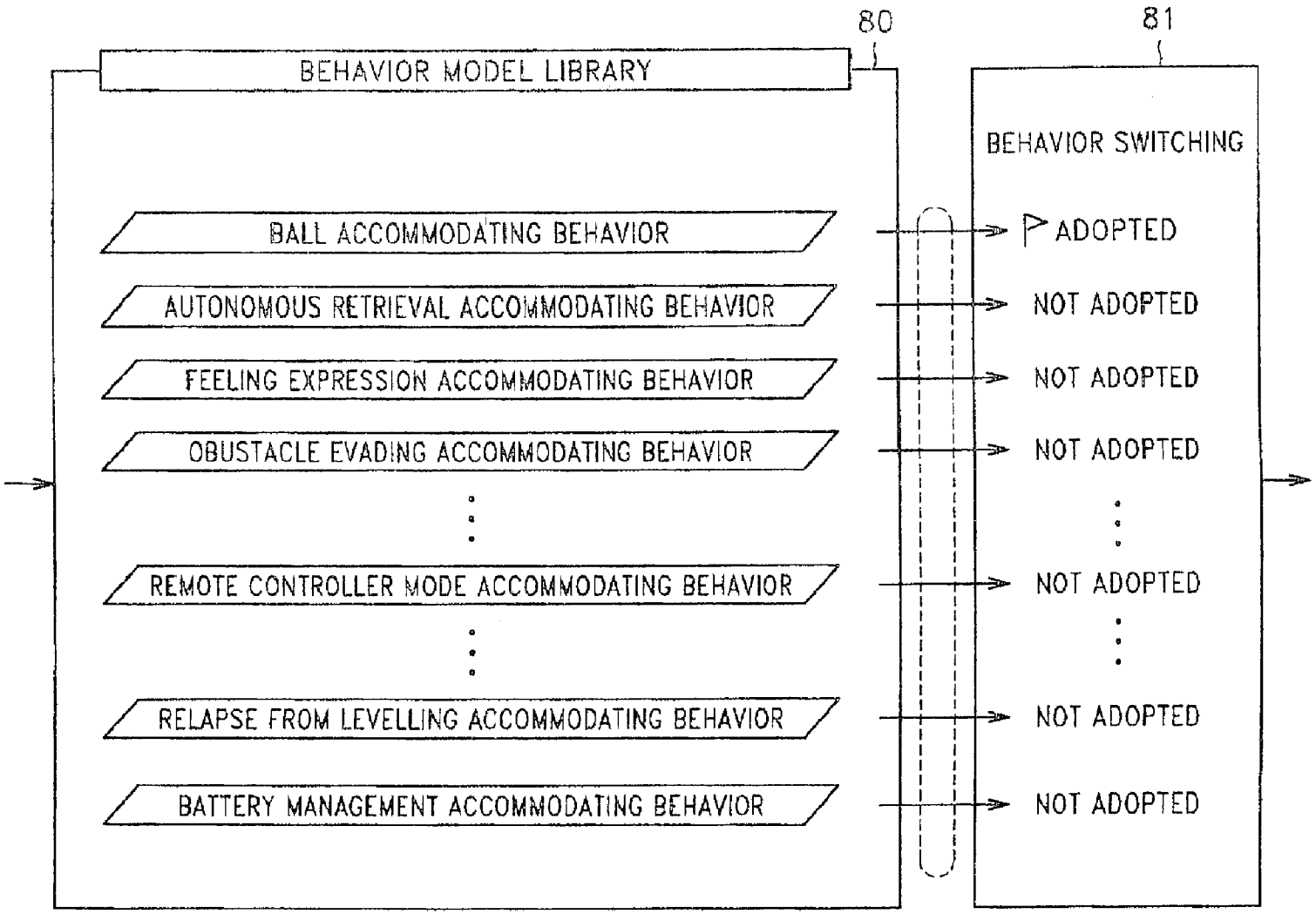
FIG. 11 is a block diagram showing the structure of a behavioral model library of the application layer.
Figure 12:
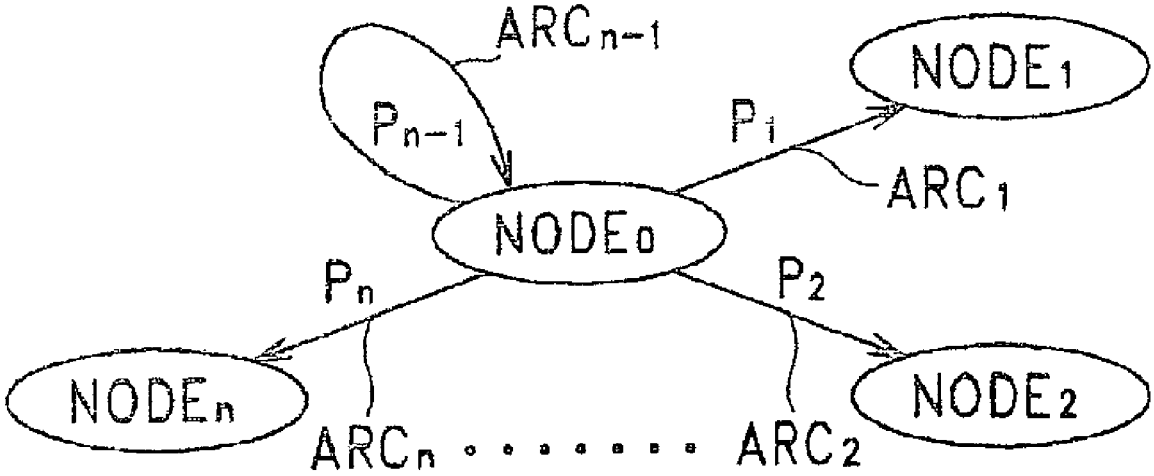
FIG. 12 illustrates a finite probability automaton as the information for determining the behavior of the robot apparatus.

The behavioral model library 80 is provided with respective independent behavioral models in association with preselected several condition items, such as "residual battery capacity is small", "restoration from a leveled down state", "an obstacle is to be evaded", "a emotion expression is to be made" or "a ball has been detected", as shown in FIG. 11.

When the recognized results are given from the input semantics converter module 69, or a preset time has elapsed since the last recognized results are given, the behavioral models determine the next ensuing behavior, as reference is had to the parameter values of the corresponding emotion as stored in the emotion model 83 or to the parameter values of the corresponding desire as held in the instinct model 84, as necessary, to output the results of decision to the behavior switching module 81.

Meanwhile, in the present embodiment, the behavioral models use an algorithm, termed a finite probability automaton, as a technique for determining the next action. With this algorithm, it is probabilistically determined to which of the nodes $NODE_0$ to $NODE_n$ and from which of the nodes $NODE_0$ to $NODE_n$, transition is to be made, based on the transition probabilities $P_l$ to $P_n$ as set for respective arcs $ARC_1$ to $ARC_n$ interconnecting the respective nodes $NODE_0$ to $NODE_n$.

Specifically, each of the behavioral models includes a status transition table 90, shown in FIG. 13, for each of the nodes $NODE_0$ to $NODE_n$, in association with the nodes $NODE_0$ to $NODE_n$, forming the respective behavioral models, respectively.

In this status transition table 90, input events (recognized results), as the transition conditions for the node in question, are listed in the order of priority, under a column entitled "names of input events", and further conditions for the transition condition in question are entered in associated rows of the columns "data names" and "data range".

Thus, if, in the node $NODE_{100}$ represented in the status transition table 90 shown in FIG. 13, the result of recognition "ball detected (BALL)" are given, the ball "size", as given together with the result of recognition, being "from 0 to 1000", represents a condition for transition to another node, whereas, if the result of recognition "obstacle detected (OBSTACLE)" is given, the "distance (DISTANCE)", as given together with the result of recognition, being "from 0 to 100", also represents a condition for transition to another node.

Also, if, in this node $NODE_{100}$, no recognized results are input, but a parameter value of any one of "joy", "surprise" and "sadness", held in the emotion model 83, among the emotion and desire parameters held in each of the emotion model 83 and the instinct model 84, periodically referenced by the behavioral models, is in a range from 50 to 100, transition may be made to another node.

In the status transition table 90, in the row "node of destination of transition" in the item of the "probability of transition to another node" are listed the names of the nodes to which transition can be made from the nodes $NODE_0$ $NODE_n$. In addition, the probability of transition to other respective nodes $NODE_0$ $NODE_n$, to which transition is possible when all of the conditions entered in the columns "input event name", "data name" and "data range" are met, is entered in a corresponding portion in the item "probability of transition to another node". The behavior to be output in making transition to the nodes $NODE_0$ to $NODE_n$ is listed in the column "output behavior" in the item "probability of transition to another node". Meanwhile, the sum of the probability values of the respective columns in the item "probability of transition to another node" is 100 (%).

Thus, if the results of recognition given in the node $NODE_{100}$, shown in the status transition table 90 of FIG. 13, are such that a ball has been detected (BALL) and the ball size is in a range from 0 to 1000, transition to "node $NODE_{120}$ (node 120)" can be made with a probability of 30%, with the behavior of "ACTION 1" then being output.

The behavioral models are arranged so that a plural number of nodes such as the node $NODE_0$ to node $NODE_n$ listed in the status transition table 100 are concatenated, such that, if the results of recognition are given from the input semantics converter module 69, the next action to be taken may be determined probabilistically using the status transition table for the node $NODE_0$ to node $NODE_n$, with the results of decision being then output to the behavior switching module 81.

The behavior switching module 81, shown in FIG. 10, selects the behavior output from the behavior model of the behavioral models of the behavioral model library 80 having a high value of the preset priority sequence, and issues a command for executing the behavior (behavior command) to the output semantics converter module 78 of the middleware layer 50. Meanwhile, in the present embodiment, the behavioral models shown in FIG. 11 become higher in priority sequence the lower the position of entry of the behavioral model in question.

On the other hand, the behavior switching module 81 advises the learning module 82, emotion model 83 and the instinct model 84 of the completion of the behavior, after completion of the behavior, based on the behavior end information given from the output semantics converter module 78. The learning module 82 is fed with the results of recognition of the teaching received as the user's action, such as "hitting" or "patting" among the results of recognition given from the input semantics converter module 69.

Based on the results of recognition and the notification from the behavior switching module 71, the learning module 82 changes the values of the transition probability in the behavioral models in the behavioral model library 70 so that the probability of occurrence of the behavior will be lowered or elevated if robot is "hit" or "scolded" for the behavior or is "patted" or "praised" for the behavior, respectively.

On the other hand, the emotion module 83 holds parameters representing the intensity of each of six sorts of the emotion, namely "joy", "sadness", "anger", "surprise", "disgust" and "fear". The emotion module 83 periodically updates the parameter values of these respective sorts of the emotion based on the specified results of recognition given from the input semantics converter module 69, such as "being hit" or "being patted", the time elapsed and the notification from the behavior switching module 81.

Specifically, with the amount of change deltaE[t] of the emotion, the current value of the emotion E[t] and with the value indicating the sensitivity of the emotion $k_e$, calculated based e.g., on the results of recognition given by the input semantics converter module 69, the behavior of the robot apparatus 1 at such time or the time elapsed as from the previous updating, respectively, the emotion model 83 calculates a parameter value E[t+1] of the emotion of the next period, in accordance with the following equation (1):

$$E[t+1]=E[t]+k_e\times \mathrm{delta}E[t] \quad (1)$$

and substitutes this for the current parameter value for the emotion E[t] to update the parameter value for the emotion. In similar manner, the emotion model 83 updates the parameter values of the totality of the various sorts of the emotion.

It should be noted that the degree to which the results of recognition or the notification of the output semantics converter module 78 influence the amounts of variation deltaE[t] of the parameter values of the respective sorts of the emotion is predetermined, such that, for example, the results of recognition of "being hit" appreciably influence the amount of variation deltaE[t] of the parameter value of the emotion of "anger", whilst the results of recognition of "being patted" appreciably influence the amount of variation deltaE[t] of the parameter value of the emotion of "joy".

It should be noted that the notification from the output semantics converter module 78 is the so-called behavior feedback information (behavior completion information) or the information on the result of occurrence of the behavior. The emotion model 83 also changes the emotion based on this information. For example, the emotion level of anger may be lowered by the behavior such as "shouting". Meanwhile, the notification from the output semantics converter module 78 is also inputted to the learning module 82, such that the learning module 82 changes the corresponding transition probability of the behavioral models.

Meanwhile, the feedback of the results of the behavior may be achieved based on an output of the behavior switching module 81 (behavior tuned to emotion).

On the other hand, the instinct model 74 holds parameters indicating the strength of each of the four independent items of desire, namely "desire for exercise", "desire for affection", "appetite" and "curiosity", and periodically updates the parameter values of the respective desires based on the results of recognition given from the input semantics converter module 69, elapsed time or on the notification from the behavior switching module 81.

Specifically, with the amounts of variation deltaI[k], current parameter values I[k] and coefficients $k_i$ indicating the sensitivity of the "desire for exercise", "desire for affection" and "curiosity", as calculated in accordance with preset calculating equations based on the results of recognition, time elapsed or the notification from the output semantics converter module 78, the instinct model 84 calculates the parameter values I[k+1] of the desires of the next period, every preset period, in accordance with the following equation (2):

$$I[k+1]=I[k]+ki\times \mathrm{delta}I[k] \quad (2)$$

and substitutes this for the current parameter value I[k] of the desires in question. The instinct model 84 similarly updates the parameter values of the respective desires excluding the "appetite".

It should be noted that the degree to which the results of recognition or the notification from the output semantics converter module 78, for example, influence the amount of variation deltal[k] of the parameter values of the respective desires is predetermined, such that a notification from the output semantics converter module 68 influences the amount of variation deltal[k] of the parameter value of "fatigue" appreciably.

It should be noted that, in the present embodiment, the parameter values of the respective values of the emotion and the respective desires (instincts) are controlled to be changed in a range from 0 to 100, whilst the values of the coefficients $k_o$ and $k_i$ are separately set for the respective sorts of the emotion and desires.

On the other hand, the output semantics converter module 78 of the middleware layer 50 gives abstract behavioral commands, supplied from the behavior switching module 81 of the application layer 51, such as "move forward", "rejoice", "utter" or "tracking (a ball)", to the associated signal processing modules 71 to 77 of an outputting system 79, as shown in FIG. 9.

On receipt of the behavioral commands, the signal processing modules 71 to 77 generate servo command values to be given the corresponding actuators, speech data of the sound to be output from the loudspeaker and/or driving data to be given the LEDs operating as "eyes" of the robot, based on the behavioral commands, to send out these data sequentially to the associated actuators, loudspeaker or to the LEDs through the virtual robot 43 of the robotics server object 42 and the signal processing circuit.

In this manner, the robot apparatus 1 is able to take autonomous behavior, responsive to its own status and to the status of the environment (outside), or responsive to commands or actions from the user, based on the above-described control program.

This control program is furnished via a recording medium recorded in a form that can be read by the robot apparatus 1. The recording medium for recording a control program may include a recording medium of the magnetic readout type, such as a magnetic tape, a flexible disc or a magnetic card, a recording medium of the optical readout type, such as CD-ROM, MO, CD-R and DVD. The recording medium also includes a recording medium, such as a semiconductor memory (so-called memory card, without regard to the outer shape, such as a rectangular or square shape, and an IC card. The control program may also be furnished over Internet.

These control programs are reproduced by a dedicated readout driver device, or a personal computer, so as to be transmitted over a cabled or a radio path to the robot apparatus 1 where it is read. If the robot apparatus 1 includes a drive device for a recording medium, reduced in size, such as a semiconductor memory or an IC card, the control program may be directly read from this recording medium.

(3-3) Mounting of the Speech Uttering Algorithm to the Robot Apparatus

The robot apparatus can be constructed as described above. The above-described uttering algorithm is mounted as a sound reproduction module 77 of the robot apparatus 1 shown in FIG. 3.

The sound reproduction module 77 is responsive to a sound outputting command, such as a command 'utter with happiness', as set in an upper order portion, such as a behavioral model, to generate actual sound time domain data, to transmit the data to a loudspeaker device of the virtual robot 43. This causes the robot apparatus to utter a text, tuned to the emotion, through loudspeaker 27 shown in FIG. 7.

The behavioral model, generating the speech utterance command, tuned to the emotion (referred to below as utterance behavioral model), is now explained. The utterance behavioral model is provided as one of the behavioral models in the behavioral model library 80 shown in FIG. 10.

The utterance behavioral model references the latest parameter value from the emotion model 83 and from the instinct model 84 to decide on the status transition table 90 shown in FIG. 13 based on the parameter values. That is, the emotion value is used as the condition for transition from a given state and executes the uttering behavior conforming to the emotion at the time of transition.

The status transition table, used by the utterance behavioral model, may be expressed as shown for example in FIG. 14. Although the status transition table used in the utterance behavioral model shown in FIG. 14 differs in the form of representation from the status transition table 90 shown in FIG. 13, the difference is not crucial. The status transition table, shown in FIG. 14, is now explained.

In the present instance, happiness, sadness, anger and timeout are given as transition conditions from the node 'nodeXXX' to another node. There are given specified numerical values, namely happiness>70, sadness>70, anger>70 and timeout=timeout.1, as transition conditions to happiness, sadness, anger and timeout, where timeout.1 is a numerical figure, such as one indicating preset time.

As the node of possible transition from 'node XXX', the node YYY, node ZZZ, node WWW and the node VVV are provided, while the behaviors executed for these respective nodes are allocated as 'banzai', 'otikomu', 'buruburu' and 'akubi'.

The expression behavior for 'banzai' is defined as the utterance expressing the emotion of 'happiness' (talkhappy)'and as the motion of 'banzai' by the arm units 4R/L (motion_banzai). For making the utterance of emotion expression of 'happiness', the parameters for emotion expression of happiness, provided at the outset, as described above, are used. That is, the happiness is uttered based on the utterance algorithm described above.

The expression behavior for 'otikomu' meaning 'depression' is defined as the utterance expressing the emotion of 'sadness' (talk_sad) and as the intimidated motion (motion_ijiiji). For making the utterance of emotion expression of 'sadness', the parameters for emotion expression of sadness, provided at the outset, are used. That is, the utterance of sadness are made based on the previously explained utterance algorithm.

The expression behavior for 'buruburu' (onomatopoeia for trembling) is defined as the utterance with emotion expression of 'anger' (talk_anger) and the movement of trembling for anger (motion_buruburu). For making the utterance with emotion expression, the aforementioned parameters for emotion expression of 'anger', previously defined, are used. That is, the utterance of anger is made based on the utterance algorithm previously explained.

The expression behavior of 'akubi', meaning 'yawning', is defined as the movement of yawning from boredom of having nothing special to do.

In this manner, the respective behaviors to be executed in each of the nodes, to which transition can be made, are defined, and the transition to each of these nodes is determined by the probability table. The transition to each node is determined by the probability table stating the probability of behavior in case the conditions for transition are met.

Referring to FIG. 14, in the case of happiness, that is when the value of happiness has exceeded the threshold value of 70, which is held as being a preset threshold value, the expressive behavior of 'banzai' is selected with 100% probability. In the case of sadness, that is if the value of sadness has exceeded the preset threshold value of 70, the expressive behavior of 'otikomu' meaning 'depression' is selected. In the case of the anger, that is if the value of ANGER has exceeded the preset threshold value of 70, the expressive behavior of 'buruburu' is selected with 100% probability. In the case of the timeout, that is if the value of TIMEOUT is equal to the threshold value of timeout.1, the expressive behavior of 'akubi' is selected with 100% probability. Meanwhile, in the present embodiment, the behavior is selected at all times with 100% probability, that is the behavior is manifested necessarily. This, however, is not limitative, such that the behavior of 'banzai' may be designed to be selected with 70% probability in case of the happiness.

By defining the status transition table of the utterance behavior model as described above, utterance by the robot apparatus in meeting with the robot's emotion can be controlled freely in keeping with sensor inputs or robot's state.

In the above-described embodiment, the duration, pitch and the sound volume have been taken as examples of parameters modified with the emotion. This, however, is not limitative such that sentence forming factors affected by the emotion may also be used as parameters.

In the above-described embodiment, the emotion model of the robot apparatus is formed by the emotion, such as happiness or anger. However, the present invention is not limited to the constitution of the emotion model by the emotion such that the emotion model may also be formed by other factors influencing the emotion. In this case, parameters forming the sentence are controlled by these other factors.

In the description of the above-described embodiment, it is assumed that the emotion factor is added by modifying the parameters of the prosodic data, such as pitch, duration or sound volume). This, however, is not limitative such that the emotion factor can be added by modifying the phoneme itself.

It is noted that, for modifying the phoneme itself, a parameter VOICED, for example, is added to the table associated with the above-described respective emotions. This parameter assumes two values of '+' and '−', such that, if the parameter is '+', the unvoiced sound is changed to voiced sound. In the case of the Japanese language, the voiceless sound is changed to the dull sound.

As an example, the case of adding the emotion of 'sadness' to the text 'kuyashii' meaning 'I repent'. The prosodic data, created from the text 'kuyashii', is represented, as an example, as shown in the following Table 14:

TABLE 14

| | | | | | | | | |
|---|---|---|---|---|---|---|---|---|
| k | 100 | 141 | | | | | | |
| U | 100 | 105 | 3 | 97 | 36 | 98 | 71 | 99 |
| j | 100 | 60 | 68 | 108 | | | | |
| a | 100 | 106 | 21 | 109 | 70 | 110 | | |
| S | 100 | 174 | 29 | 112 | 74 | 112 | | |
| I | 100 | 151 | 14 | 112 | 49 | 104 | 78 | 90 |

In the emotion of 'sadness', VOICED is '+' and the parameters are changed in the emotion filter 204 as indicated in the following Table 15;

TABLE 15

| | | | | | | | | |
|---|---|---|---|---|---|---|---|---|
| g | 100 | 141 | | | | | | |
| U | 100 | 105 | 3 | 97 | 36 | 98 | 71 | 99 |
| j | 90 | 60 | 68 | 108 | | | | |
| a | 90 | 106 | 21 | 109 | 70 | 110 | | |
| Z | 100 | 174 | 29 | 112 | 74 | 112 | | |
| I | 100 | 151 | 14 | 112 | 49 | 104 | 78 | 90 |

By the phoneme 'k' and 's' being changed to the phoneme 'g' and 'z', respectively, the original text 'kuyashii' is changed to 'guyazii', thus giving an impression of uttering 'kuyashii' with a emotion of sadness.

Instead of changing a certain phoneme to another phoneme, it is also possible to provide phoneme symbols different from emotion to emotion to express the same phoneme and to select the phoneme symbol of a particular emotion depending on parameters. For example, the standard phoneme symbol expressing the sound [a] may be held to be 'a', and different phoneme symbols such as 'a_anger', 'a_sadness', 'a_comfort' and 'a_happiness' may be provided for the emotions 'anger', 'sadness', 'comfort' and 'happiness', respectively, and the phoneme symbols for particular emotions may be selected by parameters.

The probability of changing the phoneme symbol can be specified by adding the parameter PROB_PHONEME_CHANGE to the table associated with each emotion. For example, if PROB_PHONEME_CHANGE=30, 30% of the phoneme symbols that can be changed are changed to different phoneme symbols. This probability is not limited to fixed values by the parameters, such that the phoneme symbols can be changed with a probability that becomes higher the higher becomes the degree of the emotion. Since it may be an occurrence that the meaning cannot be transmitted by changing only a fraction of the phonemes, the change probability can be specified to 100% or 0% from word to word.

The technique of expressing the emotion by changing the phoneme itself is effective not only for the case of uttering a meaningful specific language, but also for the case of uttering nonsensical words.

Although the instance of changing the parameters of the prosodic data or phonemes by the emotion is explained in the foregoing, this is not limitative, such that the parameters of the prosodic data or phonemes may be changed for representing e.g., the property of a character. That is, in such case, the constraint information can similarly be produced in such a manner that the uttered contents will not be changed by changing the parameters or phonemes.

What is claimed is:

1. A speech synthesis method for receiving information on an emotion to synthesize the speech, comprising:

a prosodic data forming step of forming prosodic data from a string of pronunciation marks which is based on an uttered text, uttered as speech;

a constraint information generating step of generating constraint information used for maintaining a selected prosodic feature of the uttered text, said selected prosodic feature of a particular phoneme is chosen to maintain the meaning and contents of a word contained in the uttered text;

a parameter changing step of changing parameters of said prosodic data, in consideration of said constraint information, responsive to the information on the emotion; and a speech synthesis step of synthesizing the speech based on said prosodic data the parameters of which have been changed in said parameter changing step, wherein, in the parameter changing step, the information on emotion cannot change the prosodic data of the selected prosodic feature.

2. The speech synthesis method according to claim 1 wherein the uttered text is a specific language.

3. The speech synthesis method according to claim 1, wherein said constraint information is annexed to said prosodic data.

4. The speech synthesis method according to claim 1, wherein said parameters are at least one selected from the group consisting of the pitch, duration and sound volume of the phoneme.

5. The speech synthesis method according to claim 4, wherein said selected prosodic feature is the position of an accent core of an accent phrase contained in the uttered text;

wherein, in said constraint information generating step, the information indicating the position of said accent core is generated; and wherein, in said parameter changing step, said pitch in said prosodic data is selectively changed.

6. The speech synthesis method according to claim 4, wherein said selected prosodic feature is a continuous rising pitch pattern or a continuous falling pitch pattern in the vicinity of the trailing end of said uttered text or a paragraph contained in said uttered text;

wherein, in said constraint information generating step, the information indicating said pattern is generated; and wherein, in said parameter changing step, said pitch in said prosodic data is selectively changed.

7. The speech synthesis method according to claim 4, wherein said selected prosodic feature is the time duration of a particular phoneme in case the meaning and contents of a word contained in an uttered text are changed due to the difference in the duration of the particular phoneme in said word;

wherein, in said constraint information generating step, the information specifying an upper limit and/or a lower limit of the time duration of said particular phoneme is generated; and wherein, in said parameter changing step, said time duration in said prosodic data is changed so as to satisfy upper and/or lower limits of said time duration.

8. The speech synthesis method according to claim 4, wherein said selected prosodic feature is an accent position in said word in case the meaning and the contents of a word contained in said uttered text are changed with said accent position;

wherein, in said constraint information generating step, the information indicating said accent information is generated; and wherein, in said parameter changing step, said sound volume in said prosodic data is selectively changed.

9. The speech synthesis method according to claim 4 wherein said selected prosodic feature is the relative intensity among a plurality of words contained in the uttered text when the meaning and contents of said uttered text are changed by said relative intensity;

wherein, in said constraint information generating step, the information representing said relative intensity is generated; and wherein, in said parameter changing step, said sound volume in said prosodic data is selectively changed.

10. The speech synthesis method according to claim 4, wherein there are provided a plurality of phoneme symbols corresponding to emotion states for one phoneme; and wherein, in said parameter changing step, at least a portion of the phoneme symbols is changed responsive to emotion states discriminated in an emotion model.

11. The speech synthesis method according to claim 1, wherein, in said parameter changing step, the parameters of said prosodic data in a portion containing said selected prosodic features are not changed.

12. The speech synthesis method according to claim 1, wherein, in said parameter changing step, the parameters of said prosodic data are changed while the magnitude relation, difference or ratio of parameter values in a portion containing said selected prosodic features is maintained.

13. The speech synthesis method according to claim 1, wherein, in said parameter changing step, the parameters of said prosodic data are changed so that a parameter value in a portion containing said selected prosodic features is within a predetermined range.

14. The speech synthesis method according to claim 1, wherein, in said parameter changing step, at least a portion of the phoneme symbols is changed to other phoneme symbols.

15. The speech synthesis method according to claim 14, wherein whether or not the phoneme symbols are to be changed is specified from one phoneme in the uttered text to another, from one word in the uttered text to another, from one paragraph in the uttered text to another, from one accent phrase to another or from one uttered text to another.

16. The speech synthesis method according to claim 1, wherein said prosodic data is added to said string of pronunciation marks.

17. A speech synthesis method for receiving information on an emotion to synthesize the speech, comprising:

a data inputting step for inputting prosodic data which is based on text uttered as speech and constraint information for maintaining a selected prosodic feature of said uttered text, said selected prosodic feature of a particular phoneme is chosen to maintain the meaning and contents of a word contained in the uttered text;

a parameter changing step of changing parameters of said prosodic data, in consideration of said constraint information, responsive to the information on the emotion; and a speech synthesis step of synthesizing the speech based on the prosodic data the parameters of which have been changed in said parameter changing step, wherein, in the parameter changing step, the information on emotion cannot change the prosodic data of the selected prosodic feature.

18. The speech synthesis method according to claim 17 wherein said constraint information is added to said prosodic data.

19. The speech synthesis method according to claim 17, wherein said parameters are at least one selected from the group consisting of the pitch, time duration and sound volume of the phoneme.

20. A speech synthesis apparatus for receiving information on an emotion to synthesize the speech, comprising:

prosodic data generating means for generating prosodic data from a string of pronunciation marks which is based on text uttered as speech;

constraint information generating means for generating constraint information for maintaining a selected prosodic feature of said uttered text, said selected prosodic feature of a particular phoneme is chosen to maintain the meaning and contents of a word contained in the uttered text;

parameter changing means for changing parameters of said prosodic data, in consideration of said constraint information, responsive to the information on the emotion; and speech synthesis means for synthesizing the speech based on said prosodic data the parameters of which have been changed by said parameter changing means, wherein, in the parameter changing means, the information on emotion cannot change the prosodic data of the selected prosodic feature.

21. The speech synthesis apparatus according to claim 20 wherein said parameters are at least one selected from the group consisting of the pitch, time duration and sound volume of the phoneme.

22. A speech synthesis apparatus for receiving information on an emotion to synthesize the speech, comprising:

data inputting means for inputting prosodic data which is based on text uttered as speech, and constraint information for maintaining a selected prosodic feature of said uttered text, said selected prosodic feature of a particular phoneme is chosen to maintain the meaning and contents of a word contained in the uttered text;

parameter changing means for changing parameters of said prosodic data, in consideration of said constraint information, responsive to the information on the emotion; and speech synthesis means for synthesizing the speech based on said prosodic data the parameters of which have been changed in said parameter changing means, wherein, in the parameter changing step, the information on emotion cannot change the prosodic data of the selected prosodic feature.

23. The speech synthesis apparatus according to claim 22, wherein said parameters are at least one selected from the group consisting of the pitch, time duration and sound volume of the phoneme.

24. A computer-readable recording medium on which there is recorded a program for having a computer execute the processing of receiving information on an emotion to synthesize speech, comprising:

a prosodic data forming step of forming prosodic data from a string of pronunciation marks which is based on an uttered text, uttered as speech;

a constraint information generating step of generating constraint information used for maintaining selected prosodic features of the uttered text, said selected prosodic features of a particular phoneme are chosen to maintain the meaning and contents of a word contained in the uttered text;

a parameter changing step of changing parameters of said prosodic data, in consideration of said constraint information, responsive to the information on the emotion; and a speech synthesis step of synthesizing the speech based on said prosodic data the parameters of which have been changed in said parameter changing step, wherein, in the parameter changing step, the information on emotion cannot change the prosodic data of the selected prosodic feature.

25. The computer-readable recording medium according to claim 24, wherein said parameters are at least one selected from the group consisting of the pitch, time duration and sound volume of the phoneme.

26. A computer-readable medium storing a program for having a computer perform the processing of receiving information on an emotion to synthesize the speech, comprising:

a data inputting step for inputting prosodic data which is based on text uttered as speech and constraint information for maintaining a selected prosodic feature of said uttered text, said selected prosodic feature of a particular phoneme is chosen to maintain the meaning and contents of a word contained in the uttered text;

a parameter changing step of changing parameters of said prosodic data, in consideration of said constraint information, responsive to information on the emotion; and a speech synthesis step of synthesizing the speech based on the prosodic data, the parameters of which have been changed in said parameter changing step, wherein, in the parameter changing step, the information on emotion cannot change the prosodic data of the selected prosodic feature.

27. The computer-readable medium according to claim 26, wherein said parameters are at least one selected from the group consisting of the pitch, time duration and sound volume of the phoneme.

28. A method for generating constraint information comprising:

a constraint information generating step of being fed with a string of pronunciation marks specifying an uttered text, uttered as speech, for generating constraint information for maintaining a selected prosodic feature of said uttered text when changing parameters of prosodic data prepared from said string of pronunciation marks in accordance with parameter change control information, wherein, said selected prosodic feature of a particular phoneme is chosen to maintain the meaning and contents of a word contained in the uttered text, and wherein changing parameters of the prosodic data cannot change the prosodic data of the selected prosodic feature.

29. The constraint information generating method according to claim 28, wherein the uttered text is a specific language.

30. The constraint information generating method according to claim 28, wherein said parameter change control information is the emotion state information or the character information.

31. The constraint information generating method according to claim 28, wherein said constraint information is annexed to said prosodic data.

32. The constraint information generating method according to claim 28, wherein said parameters are at least one selected from the group consisting of the pitch, duration and sound volume of the phoneme.

33. The constraint information generating method according to claim 32, wherein, in said constraint information generating step, constraint information for maintaining the parameters of said prosodic data in a portion containing said selected prosodic features is generated.

34. The constraint information generating method according to claim 32, wherein, in said constraint information generating step, constraint information for maintaining the magnitude relation, difference or ratio of the parameter values in a portion containing said selected prosodic features is generated.

35. The constraint information generating method according to claim 32, wherein, in said constraint information generating step, constraint information for maintaining said parameter value in a portion containing said selected prosodic features is within a predetermined range.

36. The constraint information generating method according to claim 32, wherein said selected prosodic feature is a position of an accent core of an accent phrase contained in the uttered text; and wherein, in said constraint information generating step, the information indicating the position of said accent core is generated.

37. The constraint information generating method according to claim 32, wherein said selected Prosodic feature is a continuous rising pitch pattern or a continuous falling pitch pattern in the vicinity of the trailing end of said uttered text or the vicinity of the boundary of a paragraph contained in said uttered text; and wherein, in said constraint information generating step, the information indicating said pattern is generated.

38. The constraint information generating method according to claim 32, wherein said selected prosodic feature is the time duration of a specified phoneme in case the meaning and contents of a word contained in the uttered text are changed by the difference in time duration of said specified phoneme; and wherein, in said constraint information generating step, the information indicating the upper and/or lower limit of the time duration of said specified music is generated.

39. The constraint information generating method according to claim 32, wherein said selected prosodic feature is a stress position of a word contained in an uttered text in case the meaning and contents of said word are changed by said stress position; and wherein, in said constraint information generating step, the information indicating said stress position is generated.

40. The constraint information generating method according to claim 32, wherein said selected prosodic feature is the relative intensity among respective words contained in the uttered text when the meaning and the contents of said uttered text are changed by said relative intensity among said respective words; and wherein, in said control information generating step, the information indicating said relative intensity is generated.

41. An apparatus for generating constraint information comprising:

constraint information generating means for being fed with a string of pronunciation marks specifying an uttered text, uttered as speech, for generating constraint information for maintaining a selected prosodic feature of said uttered text when changing parameters of prosodic data prepared from said string of pronunciation marks in accordance with parameter change control information.

wherein, said selected prosodic feature of a particular phoneme is chosen to maintain the meaning and contents of a word contained in the uttered text, and wherein changing parameters of the prosodic data cannot change the prosodic data of the selected prosodic feature.

42. The constraint information generating apparatus according to claim 41, wherein said parameter change control information is the emotion state information or the character information.

43. The constraint information generating apparatus according to claim 41, wherein said parameters are at least one selected from the group consisting of the pitch, duration and sound volume of the phoneme.

44. An autonomous robot apparatus performing a movement based on the input information supplied thereto, comprising:

an emotion model ascribable to said movement; emotion discrimination means for discriminating the emotion state of said emotion model;

prosodic data creating means for creating prosodic data from a string of pronunciation marks which is based on the text uttered as speech;

constraint information generating means for generating the constraint information for maintaining a selected prosodic feature of said uttered text, said selected prosodic feature of a particular phoneme is chosen to maintain the meaning and contents of a word contained in the uttered text;

parameter changing means for changing parameters of said prosodic data, in consideration of said constraint information, responsive to the emotion state discriminated by said discriminating means; and speech synthesizing means for synthesizing the speech based on said prosodic data the parameters of which have been changed by the parameter changing means, wherein changing parameters of the prosodic data cannot change the prosodic data of the selected prosodic feature.

45. The autonomous robot apparatus according to claim 44, wherein the uttered text is a specific language.

46. The autonomous robot apparatus according to claim 44, wherein said constraint information is annexed to said prosodic data.

47. The autonomous robot apparatus according to claim 44, wherein said parameters are at least one selected from the group consisting of the pitch, duration and sound volume of the phoneme.

48. The autonomous robot apparatus according to claim 47, wherein said parameter changing means does not change the parameters of said prosodic data in a portion containing said selected prosodic features.

49. The autonomous robot apparatus according to claim 47, wherein said parameter changing means changes the parameters of said prosodic data, maintaining the magnitude relation, difference or ratio of the parameter values in a portion containing said selected prosodic features.

50. The autonomous robot apparatus according to claim 47, wherein said parameter changing means changes the parameters of said prosodic data so that said parameter value in a portion containing said selected prosodic features is within a predetermined range.

51. The autonomous robot apparatus according to claim 47, wherein said selected prosodic feature is the position of an accent core of an accent phrase contained in the uttered text;

wherein, in said constraint information generating means, the information indicating the position of said accent core is generated; and wherein, in said parameter changing means, said pitch in said prosodic data is selectively changed.

52. The autonomous robot apparatus according to claim 47, wherein said selected prosodic feature is a continuous rising pitch pattern or a continuous falling pitch pattern in the vicinity of the trailing end of said uttered text or the vicinity of the boundary of a paragraph contained in said uttered text;

wherein, in said constraint information generating means, the information indicating said pattern is generated; and wherein, in said parameter changing means, said pitch in said prosodic data is selectively changed.

53. The autonomous robot apparatus according to claim 47, wherein said selected prosodic feature is the time duration of a particular phoneme in case the meaning and contents of a word contained in an uttered text are changed due to the difference in the duration of the particular phoneme in said word;

wherein, in said constraint information changing means, the information specifying an upper limit and/or a lower limit of the time duration of said particular phoneme is generated; and wherein, in said parameter changing means, said time duration in said prosodic data is changed so as to satisfy upper and/or lower limits of said time duration.

54. The autonomous robot apparatus according to claim 47, wherein said selected prosodic feature is the stress position in case the meaning and the contents of a word contained in said uttered text are changed with a stress position in said word;

wherein, in said constraint information generating means, the information indicating said stress information is generated; and wherein, in said parameter changing means, said sound volume in said prosodic data is selectively changed.

55. The autonomous robot apparatus according to claim 47, wherein said selected prosodic feature is the relative intensity among a plurality of words contained in the uttered text when the meaning and contents of said uttered text are changed by said relative intensity;

wherein, in said constraint information generating means, the information representing said relative intensity is generated; and wherein, in said parameter changing means, said sound volume in said prosodic data is selectively changed.

56. The autonomous robot apparatus according to claim 44 further comprising emotion model changing means for determining said movement by changing the state of said emotion model based on said input information.

57. An autonomous robot apparatus performing a movement based on the input information supplied thereto, comprising:

an emotion model ascribable to said movement;

emotion discrimination means for discriminating the emotion state of said emotion model;

data inputting means for inputting prosodic data which is based on the text uttered as speech and constraint information for maintaining a selected prosodic feature of said uttered text, said selected prosodic feature of a particular phoneme is chosen to maintain the meaning and contents of a word contained in the uttered text;

parameter changing means for changing parameters of said prosodic data, in consideration of said constraint information, responsive to the emotion state discriminated by said discriminating means; and speech synthesizing means for synthesizing the speech based on said prosodic data, the parameters of which have been changed by the parameter changing means, wherein changing parameters of the prosodic data cannot change the prosodic data of the selected prosodic feature.

58. The autonomous robot apparatus according to claim 57, wherein said constraint information is annexed to said prosodic data.

59. The autonomous robot apparatus according to claim 57, wherein said parameters are at least one selected from the group consisting of the pitch, duration and sound volume of the phoneme.

* * * * *